US007892098B2

(12) United States Patent
Nguyen et al.

(10) Patent No.: US 7,892,098 B2
(45) Date of Patent: Feb. 22, 2011

(54) UNIVERSAL GAMING ENGINE

(75) Inventors: Binh T. Nguyen, Reno, NV (US); James W. Stockdale, Clio, CA (US)

(73) Assignee: IGT, Reno, NV (US)

( * ) Notice: Subject to any disclaimer, the term of this patent is extended or adjusted under 35 U.S.C. 154(b) by 1031 days.

(21) Appl. No.: 10/810,166

(22) Filed: Mar. 26, 2004

(65) Prior Publication Data

US 2005/0215325 A1 Sep. 29, 2005

(51) Int. Cl.
*A63F 9/24* (2006.01)

(52) U.S. Cl. ..... 463/46; 463/16; 463/42; 463/47

(58) Field of Classification Search ..... 463/16, 463/42–47
See application file for complete search history.

(56) References Cited

U.S. PATENT DOCUMENTS

| | | | | |
|---|---|---|---|---|
| 3,713,142 | A | 1/1973 | Getchell | |
| 4,583,082 | A | 4/1986 | Naylor | |
| 5,534,849 | A | 7/1996 | McDonald et al. | |
| 5,643,086 | A | 7/1997 | Alcorn et al. | |
| 5,761,647 | A | 6/1998 | Boushy | |
| 5,907,141 | A | 5/1999 | Deaville et al. | |
| 5,912,619 | A | 6/1999 | Vogt | |
| 5,923,249 | A | 7/1999 | Muir | |
| 5,999,952 | A * | 12/1999 | Jenkins et al. | 708/100 |
| 6,104,815 | A | 8/2000 | Alcorn et al. | |
| 6,106,396 | A | 8/2000 | Alcorn et al. | |
| 6,146,274 | A | 11/2000 | Salour et al. | |
| 6,149,522 | A | 11/2000 | Alcorn et al. | |
| 6,178,510 | B1 * | 1/2001 | O'Connor et al. | 726/5 |
| 6,213,277 | B1 | 4/2001 | Blad et al. | |
| 6,251,014 | B1 | 6/2001 | Stockdale et al. | |

(Continued)

FOREIGN PATENT DOCUMENTS

AU 2005201254 10/2010

(Continued)

OTHER PUBLICATIONS

Examination Report from Counterpart Foreign Application No. GB0505252.7, Dec. 21, 2006, 3 pages.

(Continued)

*Primary Examiner*—Dmitry Suhol
*Assistant Examiner*—Andrew Kim
(74) *Attorney, Agent, or Firm*—Weaver Austin Villeneuve & Sampson LLP

(57) ABSTRACT

Apparatuses and systems including a gaming machine having one or more major components that are removable and interchangeable with other similar major components for a gaming machine are disclosed. Such a gaming machine has at least a master gaming controller, one or more major components, and a universal gaming engine. At least one major component, such as a top box or main cabinet, contains a plurality of peripheral devices and a universal communication interface, is adapted to be removable from the gaming machine, and is interchangeable with other similar major components. The universal gaming engine contains at least one dedicated processing unit, such as a CPU, at least one associated storage device, and its own universal communication interface. This universal gaming engine is also adapted to control a substantial portion of the plurality of peripheral devices on the removable and interchangeable major component of the gaming machine.

30 Claims, 12 Drawing Sheets

U.S. PATENT DOCUMENTS

| | | | | |
|---|---|---|---|---|
| 6,315,666 | B1 * | 11/2001 | Mastera et al. | 463/31 |
| 6,575,833 | B1 | 6/2003 | Stockdale | |
| 6,697,903 | B2 | 2/2004 | Massie et al. | |
| 6,722,985 | B2 | 4/2004 | Criss-Puszkiewicz | |
| 7,112,138 | B2 | 9/2006 | Hedrick et al. | |
| 2002/0019891 | A1 | 2/2002 | Morrow et al. | |
| 2002/0138594 | A1 * | 9/2002 | Rowe | 709/219 |
| 2003/0054881 | A1 | 3/2003 | Hedrick et al. | |
| 2004/0254006 | A1 | 12/2004 | Lam et al. | |
| 2005/0054449 | A1 * | 3/2005 | Kopera et al. | 463/46 |
| 2007/0155512 | A1 | 7/2007 | Wells et al. | |
| 2008/0254880 | A1 | 10/2008 | Dreyer et al. | |

FOREIGN PATENT DOCUMENTS

| | | | |
|---|---|---|---|
| DE | 3601157 | | 7/1987 |
| DE | 3802601 | | 8/1989 |
| DE | 9101529 | | 5/1991 |
| DE | 4140451 | | 6/1993 |
| DE | 29713455 | | 10/1997 |
| EP | 0436258 | | 7/1991 |
| EP | 0 738 991 | A3 | 10/1996 |
| EP | 1039423 | A1 | 9/2000 |
| EP | 0978809 | A2 | 2/2002 |
| EP | 1197934 | | 4/2002 |
| GB | 2 393 133 | A | 3/2004 |
| GB | 2412474 | | 9/2005 |

OTHER PUBLICATIONS

Examination Report from Counterpart Foreign Application No. GB0505252.7, Jul. 13, 2006, 2 pages.

U.S. Appl. No. 10/460,822, filed Jun. 11, 2003, Lam et al.

Examination Report from Counterpart Foreign Application No. AU 2005201254, dated Nov. 26, 2009, 2 pages.

U.S. Office Action dated Mar. 5, 2010 from U.S. Appl. No. 11/644,148.

U.S. Office Action dated Jul. 22, 2010 from U.S. Appl. No. 11/644,148.

* cited by examiner

UNIVERSAL GAMING ENGINE

TECHNICAL FIELD

The present invention relates generally to gaming machines such as a slot machines or video poker machines, and more specifically to apparatuses and systems for providing interchangeable components for gaming machines.

BACKGROUND

Casinos and other forms of gaming comprise a growing multi-billion dollar industry wherein floor space can be at a premium, such that newer and increasingly sophisticated games and machines are preferred over older and less sophisticated ones. As a general example, the casino and gaming industries have experienced a marked shift over the past few decades from the use of fully mechanical gaming machines to electronic and microprocessor based gaming machines. In a typical gaming machine, such as a video poker or slot machine, a game play is first initiated through a player wager of money or credit, whereupon the gaming machine determines a game outcome, presents the game outcome to the player and then potentially dispenses an award of some type, including a monetary award, depending on the game outcome. Although this process is generally true for both mechanical and electronic gaming machines, the electronic machines tend to be more popular with players and thus more lucrative for casinos for a number of reasons, such as increased game varieties, more attractive and dynamic video and audio presentations, and the ability to award larger jackpots.

Electronic and microprocessor based gaming machines typically include a number of hardware and software components to provide a wide variety of game types and game playing capabilities, with such hardware and software components being generally well known in the art. A typical electronic gaming machine comprises a central processing unit (CPU) or master gaming controller (MGC), which is usually located in a main cabinet of the gaming machine, and which typically controls various combinations of hardware and software components, devices and peripherals that encourage game play, allow a player to play a game on the gaming machine and control payouts and other awards. Software components can include, for example, boot and initialization routines, various game play programs and subroutines, credit and payout routines, image and audio generation programs, various component modules and a random number generator, among others.

Exemplary hardware devices can include various inputs that accept money and/or credits into the gaming machine, such as bill validators, coin acceptors, card readers and ticket acceptors, as well as user inputs to determine a wager amount and initiate game play, such as keypads, buttons, levers, touch screens and the like. Other common hardware devices include payout components such as coin hoppers and ticket printers, as well as player tracking units. In addition, any given gaming machine will typically have any number of audio and video display components that can include, for example, various speakers, visual display panels, belly and top glasses, exterior cabinet artwork, lights, top box dioramas, and cathode ray tubes, liquid crystal displays (LCDs), flat panels and/or other similar video displays for displaying game play and other assorted information. Many of these peripheral components and devices are built into a main cabinet of the gaming machine itself or into items closely associated with the gaming machine, such as a top box, which usually sits atop the main cabinet.

In recent years, the functionality of electronic gaming machines has become increasingly complex, with many new and improved game play, software, hardware and peripheral devices continually being brought to market by a variety of different manufacturers. Accordingly, there are several reasons that a casino operator or gaming proprietor might have for wanting to upgrade or otherwise alter one or more existing gaming machines after such machines have already been deployed. Such reasons can include a desire to change the existing theme on the gaming machine, and/or a desire to add one or more new capabilities afforded by, for example, new or upgraded gaming software and/or new or upgraded peripheral devices, such as bill and coin acceptors, ticket acceptors and dispensers, downloadable game components, and player tracking units, among others, which can be from the same or various different manufacturers. While many of the newest and upgraded gaming machine components and peripherals can be highly desirable, implementation or changeover in existing and deployed gaming machines can be impossible or impractical in many cases.

Traditionally, electronic gaming machines have not been manufactured as devices that are readily adapted to have a large number of interchanged components or peripheral devices once such gaming machines have been deployed. To operate a given component or peripheral device, it has been common industry practice to provide a gaming machine MGC with parameters, operational characteristics and configuration information specific to that component or peripheral device. This information is incorporated into software and stored in some type of memory device on the MGC, and device specific software operates the functions of the device. For example, to operate a set of lights, the software for the MGC would require information such as the number and types of lights, functions of the lights, signals that correspond to each function, and the response time of the lights. Hence, the addition of any component or peripheral device on a deployed gaming machine would require that a sufficiently sophisticated MGC already be in place, or that the existing MGC be replaced or reprogrammed. Such provisions are not inexpensive or trivial within such a highly regulated industry.

Furthermore, while upgrading or adding a single new component or peripheral device to a deployed gaming machine might involve some MGC and/or other implementation issues, several upgrades or additions within one gaming machine can significantly change the combinations of components and peripheral devices and the resulting relationships within that machine. This can cause many problems on a number of levels. Such problems can multiply when these changes involve the introduction of components and peripherals that are manufactured by a number of different entities, especially where different functions and communication protocols are employed. With the growing number of gaming machine components and peripheral devices, as well as the growing number of manufacturers making such products, device compatibility has been a major industry concern in recent years.

Although there has been some desire within the gaming machine industry to model device compatibility after techniques that have been successfully implemented within the personal computer (PC) industry, there are many reasons as to why similar techniques are not possible or practical in the manufacture of gaming machines and related components. Such reasons can include, for example, various strict regulatory requirements that are placed upon gaming machines; the harsh environment in which gaming machines operate; the more stringent security requirements required of gaming machines; and the stricter fault tolerance requirements required of gaming machine systems, among others. Furthermore, techniques and methods for solving a problem in the PC industry, such as device compatibility and connectivity issues, might not be adequate in the gaming environment. Many faults tolerated in a PC, such as security holes or frequent crashes, may not be tolerated in a gaming machine, since such faults can lead to a loss of funds as a result of stolen cash, fraudulently procured jackpots, or loss of revenue when the gaming machine is inoperable and thus unavailable for play.

Other relevant and significant differences between gaming machine systems and common PC based systems also exist, including the fact that gaming machines must typically be state-based systems, which affects many of the software and hardware designs on the gaming machine. In a state-based system, the system stores and maintains its current state in a non-volatile memory, such that the gaming machine will return to its current state when power is restored in the event of a power failure or other similar malfunction. For instance, if a player were shown an award for a game of chance, but the power failed before the award could be provided to the player, the gaming machine would return to the state where the award is indicated upon the restoration of power. PCs are not state machines, however, as a majority of current data is usually lost whenever a power failure or similar malfunction occurs. Another important difference between gaming machine systems and PC based systems is that the software used to generate a game of chance on and operate the gaming machine must, for regulation purposes, be designed as static and monolithic to prevent cheating by the operator of gaming machine. To gain approval in most gaming jurisdictions, a gaming machine must demonstrate sufficient safeguards that prevent an operator of the gaming machine from manipulating hardware and software in a manner that gives the operator an unfair or illegal advantage. The code validation requirements in the gaming industry affect both hardware and software designs on gaming machines.

As yet another important difference between systems, various peripherals such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry. Another difference with respect to gaming machine systems is that all software must be thoroughly tested, verified, and submitted for regulatory approval before it can be placed on a gaming machine. In addition, all such software must also then be tested in the field after placement on the gaming machine. The costs associated with developing and deploying a new device on a gaming machine can thus be quite high, especially where the operating characteristics of that new device are modified such that a new device driver is required. Given these and other differences between gaming machine systems and PC systems, it is readily apparent why many solutions to problems involving device compatibility and interchangeability in PC systems may not be transferable to solve similar problems in gaming machine systems.

With the substantial issues involved in creating interchangeable components and peripheral devices for gaming machines, it is little wonder then that major gaming machine components, such as top boxes and main cabinets, have remained heavily customized and proprietary in nature over the years. Traditionally, major components for gaming machines are all custom designed and manufactured for only one specific line of gaming machines. For instance, a top box for an "Elvis" gaming machine by a given gaming machine manufacturer will only connect with and fit atop an "Elvis" gaming machine by that manufacturer, while a top box for a "Star Wars" gaming machine by a given manufacturer will similarly only connect with and fit atop a "Star Wars" gaming machine by that manufacturer. Thus, while an "Elvis" top box might be interchangeable with respect to any "Elvis" gaming machine that was made by the same manufacturer, such a top box could not be used with any other gaming machine.

In fact, top boxes can become so customized that a top box for one specific line or series of gaming machines by a given manufacturer may not even fit with other gaming machines in the same specific line or series by that same manufacturer. One example of such an occurrence is the "Wheel of Fortune" series of gaming machines designed and manufactured by IGT of Reno, Nev., which series includes at least seven different revisions of gaming machines, with the top boxes from some revisions in the series being inoperable on the gaming machines of other revisions in the series. Even where a top box is designed for a particular existing gaming machine, replacing the top box on that existing machine with the new top box can be a costly and time consuming process involving the decoupling, reconnection and testing of dozens of individual connections. Such a process is fairly uncommon, and many gaming machines are manufactured with a view that replacement of the top box for a given gaming machine will typically not occur even once within the lifetime of that gaming machine. In fact, most gaming machines are viewed and treated as monolithic machines that are retained or scrapped in their entirety when a new game or theme is desired on a machine by a gaming operator.

Similar use of other major components, such as main cabinets, renders the design and manufacture of many gaming machines as a generally proprietary and customized art, whereby major components for most machines are not interchangeable beyond the line of machines for which they were specifically designed. In fact, it is very common for the same top box, main cabinet and other major components of a gaming machine to be manufactured together as one complete unit, and then sold, distributed, deployed, used and eventually rendered obsolete and scrapped as that same original complete unit. Such traditional and pervasive customized design and use of top boxes and main cabinets for gaming machines has resulted in a common mindset among virtually all major gaming machine manufacturers that a new main cabinet and a new top box must be designed for any newly designed line of gaming machines. Not only are these and other major components typically designed from scratch for any new line of gaming machines, but customized connections between these components must then also be custom designed, as the various electrical, processing and communications demands for top boxes and other major components can vary widely depending upon the game design and level of sophistication within such components. Expenses for such practices are exacerbated by recent industry trends toward shorter game life cycles and the general industry practice to change over by scrapping entire machines.

Besides the inherent inconveniences in a lack of interchangeability with other gaming machines, other disadvantages arise from this lack of standardization. One disadvantage is that the variations in top boxes adds to the complexity of design and practicality of use for some gaming machines, as different software and hardware demands, various communication protocols, and varied shapes and sizes for each top box affect how a given machine can be used or implemented on a casino floor. A more significant disadvantage is that virtually every new gaming machine design must also be accompanied by a new customized top box design, at an added cost of hundreds of thousands of dollars. Because there are really no industry protocols or standardizations for major gaming machine components such as top boxes or main cabinets, items such as grids, harnesses, couplings, other physical connectors and communication protocols are custom designed and made for each new line of gaming machines. The design and manufacture of dozens or hundreds of customized top boxes is thus inefficient in the amount of costs, time and human resources dedicated to each new top box.

Accordingly, there exists a need for improved apparatuses and systems for providing interchangeable major components of a gaming machine, and in particular for such apparatuses and systems to involve the ability to replace, change out and/or reuse a top box, main cabinet or other major component of a gaming machine without requiring an overly costly or time consuming process.

SUMMARY

It is an advantage of the present invention to provide apparatuses and systems including a gaming machine having one or more major components that are removable and interchangeable with other similar major components for a gaming machine. This is accomplished by utilizing a universal gaming engine in association with the inventive apparatuses and systems including a gaming machine.

According to one embodiment of the present invention, the provided apparatus and system involve the use of a gaming machine having at least a master gaming controller, one or more major components, and a universal gaming engine. The master gaming controller is adapted to at least control game play and authorize payouts and other awards on the gaming machine. At least one major component, such as a top box or main cabinet, contains a plurality of peripheral devices and a universal communication interface, is adapted to be removable from the gaming machine, and is interchangeable with other similar major components. The universal gaming engine contains at least one dedicated processing unit, such as a CPU, at least one associated storage device, and its own universal communication interface. The universal gaming engine is also adapted to control a substantial portion of the plurality of peripheral devices on the removable and interchangeable major component of the gaming machine, and may also be adapted to provide power to this major component.

It is a particular advantage of the present invention to provide a gaming machine that permits the replacement or changing out of a top box, main cabinet or other major component of a gaming machine without requiring an overly costly or time consuming process. This is similarly accomplished by utilizing a universal gaming engine in association with the inventive gaming machine or gaming machine system, where such an engine is universal with respect to multiple major components or with respect to a particular major component, such as a main cabinet or a top box. Accordingly, one or more major components of the gaming machine can be removed from the gaming machine and the universal gaming engine and/or the gaming machine or system can be adapted such that a major component and the universal gaming engine can detach from the remainder of the gaming machine together.

The universal gaming engine may comprise a universal top box engine, a universal main cabinet engine, a universal engine for another major component, or a combination universal engine for one or more of the above. A second universal communication interface, such as a grid or other standardized layout of ported connections, can be present on the removable major component, such that a convenient mating of universal communication interfaces can be made between the universal gaming engine and the removable major component.

According to another embodiment of the present invention, a system or network of gaming machines can include one or more gaming machines that have one or more universal gaming engines. Such a system or network can include one or more computer servers, at least one of which can be adapted to record and provide data regarding individual gaming machines, major components of gaming machines, universal gaming engines, or any combination thereof.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and elements for the disclosed inventive universal gaming engine. These drawings in no way limit any changes in form and detail that may be made to the invention by one skilled in the art without departing from the spirit and scope of the invention.

DETAILED DESCRIPTION

An example application of an apparatus and system according to the present invention is described in this section. This example is being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following example should not be taken as definitive or limiting either in scope or setting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting; such that other embodiments may be used, and changes may be made without departing from the spirit and scope of the invention.

Figure 1:
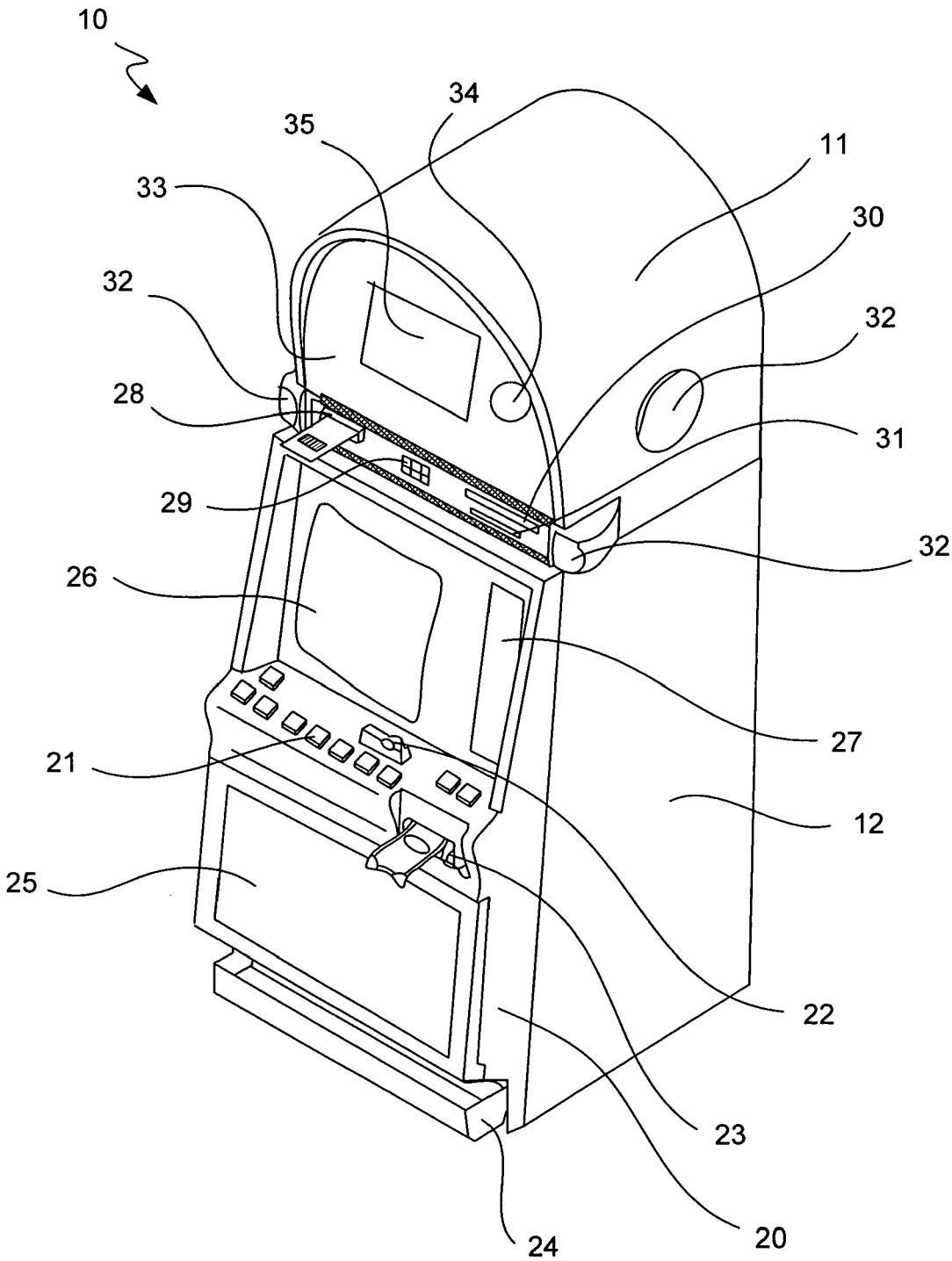
FIG. 1 illustrates in perspective view an exemplary gaming machine.

Turning now to FIG. 1, an exemplary gaming machine is illustrated in perspective view. Gaming machine 10 includes major components such as a top box 11 and a main cabinet 12, which generally surrounds the machine interior (not shown) and is viewable by users. Main cabinet 12 includes a main door 20 on the front of the machine, which opens to provide access to the machine interior. Attached to the main door are various items, which can include, for example, one or more player-input switches or buttons 21, one or more money or credit acceptors, such as a coin acceptor 22, and a bill or ticket validator 23, a coin tray 24, and a belly glass 25. Viewable through main door 20 is a primary video display 26 and one or more information panels 27. The primary video display 26 can be a cathode ray tube, high resolution flat-panel LCD, plasma/LED display or other conventional electronically controlled video monitor. Top box 11, which typically rests atop of the main cabinet 12, may also contain various items, such as a ticket printer 28, a key pad 29, one or more additional displays 30, a card reader 31, one or more speakers 32, a top glass 33, one or more cameras 34, and a secondary video display 35, which may also be a cathode ray tube, high resolution flat-panel LCD, plasma/LED display or other conventional electronically controlled video monitor.

Figure 2A:
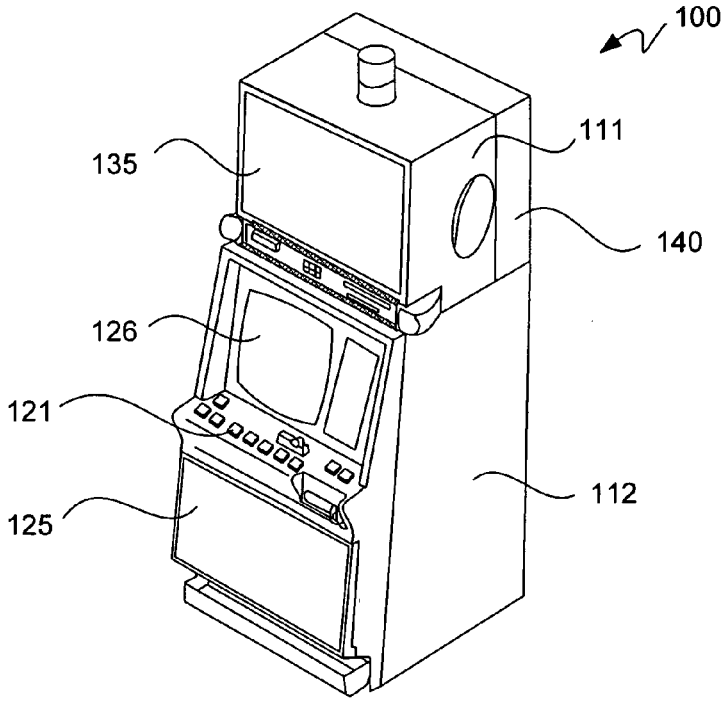
FIGS. 2A through 2C illustrate in perspective view an alternative gaming machine having an interchangeable top box and universal top box engine according to one embodiment of the present invention.
Figure 2B:
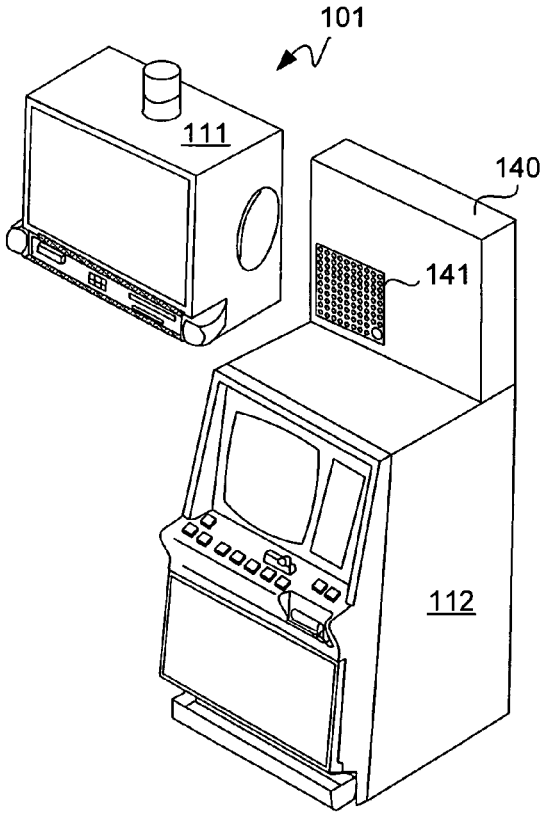
Figure 2C:
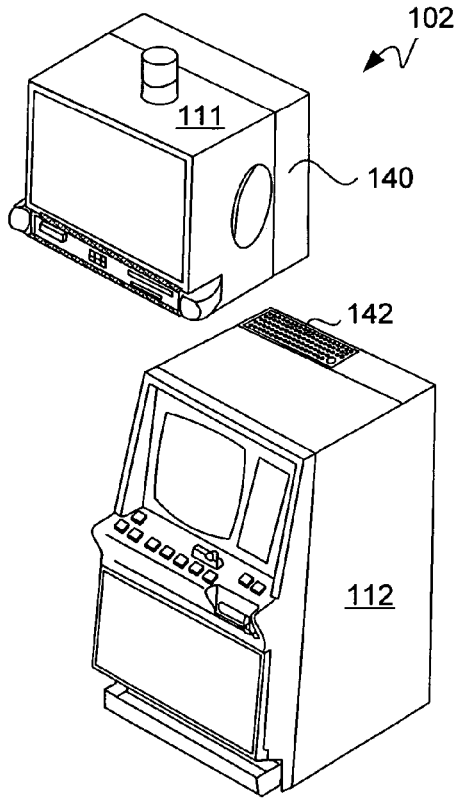

Moving now to FIGS. 2A through 2C, an alternative gaming machine having an interchangeable top box and universal top box engine according to one embodiment of the present invention is illustrated in perspective view. Similar to the previous gaming machine 10 of FIG. 1, alternative gaming machine 100 is also a gaming device that is generally adapted for accepting wagers from and granting monetary awards to players. Although alternative gaming machine 100 is generally more box-like than the previous gaming machine 10 of FIG. 1, such a difference is considered insubstantial for purposes of the present invention. In fact, it is specifically contemplated that every inventive embodiment disclosed herein can be used in conjunction with all gaming machines of any shape or size, with appropriate adaptations or adjustments made as necessary.

As in the previous example, gaming machine 100 includes a top box 111 and a main cabinet 112, both of which have a number of features substantially similar to those found in the previous gaming machine, such as, for example, one or more player-input switches or buttons 121, a belly glass 125, a primary video display monitor 126, and a secondary video display monitor 135, among others. As will be readily appreciated, not all of the foregoing exemplary features are necessary and many other features or items not illustrated may also be present or used in place of any of the features that are shown for purposes of the present invention. Unlike the foregoing example, however, top box 111 is removable from gaming machine 100, and can be interchanged with numerous other top boxes that are similarly adapted to fit atop and connect to this particular gaming machine. Such other top boxes can be substantially similar to top box 111, or, significantly, can be of different shapes, sizes and/or game themes, and can contain fewer, more or different peripheral devices having differing functionalities than those of top box 111.

To facilitate such removal and interchangeability of a major component such as a top box, gaming machine 100 also includes a universal gaming engine, specifically a universal top box engine 140. Top box 111 can then be tested, repaired, upgraded or otherwise altered while separate from the remainder of gaming machine 100, and then put back into place on the gaming machine. Alternatively, a different top box with identical, similar, or substantially different parts, components and/or game themes can be put into place on gaming machine 100. As described in greater detail below, universal top box engine 140 contains a number of components and features that enable the modular removal of top box 111. Various components and features of universal top box engine 140 that permit and facilitate the interchangeability and removal of various top boxes can include, for example, a standardized software interface, one or more software and hardware interface mediators, at least one dedicated processor, one or more associated storage devices, a universal hardware engine, simplified and standardized wirings and wiring systems, one or more external physical docking components, and a standardized hardware interface, such as a legacy plug or electrical plate or grid, among others.

In a preferred embodiment, universal top box engine 140 is a stand-alone component that attaches to a top box and at least one other major component of a gaming machine, such as a main cabinet, another universal gaming engine, or other base unit. In addition, this universal top box engine is adapted such that bi-directional communications are possible with one or more components to which it attaches. For example, as illustrated in FIG. 2A, bi-directional communications are possible between top box 111 and universal top box engine 140, as well as between main cabinet 112 and the universal top box engine. Such an arrangement can allow for the independent testing of not only the universal gaming engine, but also of every top box and main cabinet that is adapted to interface with this universal gaming engine. Accordingly, both top box 111 and main cabinet 112 can be developed as separate stand-alone major components of a gaming machine. In this manner, different teams of developers that are separately creating major components for a newly designed gaming machine can do so independently and more quickly, with fewer complications than typically arise in custom designed top boxes and other major components. Customized items that would be minimized or eliminated include, for example, developed firmware, customized code, customized architecture, and proprietary communications, among others.

As seen in FIG. 2B, one possible permutation for a gaming machine having a universal top box engine finds the universal top box engine 140 remaining with the main cabinet 112 as the top box 111 is removed from the gaming machine 101. Under such a permutation, one or more of the major components can be adapted such that a physical "docking station" is created for the convenient removal and insertion of top box 111 or another similarly adapted top box. Such an adaptation can involve placing any number of rails, guides, sliders, grooves, dowels, wheels, pins, holes, clamps, latches, locks and/or other suitable docking type items (not shown) on the top box, the main cabinet, the universal top box engine, or any combination of these major components, as desired. Also, although it is possible for universal top box engine 140 to be integrated with or permanently attached to main cabinet 112, it is preferable that these two items also be separable from each other, as described below.

In addition, a standardized hardware interface, such as an electrical plate or grid, legacy plug or other suitable communication plate is preferably built into a side of the universal gaming engine 140, with a mating hardware interface similarly built into the abutting side of the removable top box 111. Such an interface can be a "Smart Interface," which is a streamlined interface adapted to permit only the transmission of communications across major communication lines, with no power or other auxiliary items being transmitted. In such an interface, a relatively small number of major or bundled communication lines are adapted to transmit all communications between the top box and universal top box engine. For example, a ported interface containing only four connections could be adapted to allow the transmission of all communications across the interface, with one connection being dedicated to all universal serial bus (USB) type communications, another connection being dedicated to all Ethernet communications, a third connection being dedicated to all RS-232 communications and the final connection being dedicated to all analog communications. Under such a "Smart Interface," it is contemplated that an additional CPU or processor be included within the removal top box itself, as described in greater detail below. Such a top box having its own processor and being removable from the rest of the gaming machine could then be considered a rather large "smart peripheral" device.

Alternatively, this hardware interface can be a "Full Interface," wherein full power, individualized communications and other auxiliary items can be transmitted across the interface between the universal top box engine and top box. As shown in FIG. 2B, universal top box engine to top box connector plate 141 is a standardized grid of communication ports or connections, along with a ported connection to transmit power from the universal top box engine to the top box. Such a connector plate can contain, for example, 100 or so individual communication ports or connections, such that more specific instructions for individual peripheral devices or items on the top box can be transmitted directly from the universal gaming engine. These individual communication ports or connections are preferably organized according to a general standard, such that similar devices should always or usually connect to the same port.

For example, ports 1-4 can be designated as Digital Video Interface (DVI) ports, such that removable and interchangeable top boxes are always or usually designed with any secondary, tertiary and additional video displays being connected to one of these ports, while ports 5-20 can be designated as analog ports, such that various top box speakers and other analog devices will always or usually connect to one of these ports. Similar designation ranges can be given for blocks of ports that address USB devices, RS-232 devices, custom serial devices, and so forth. In addition, one or more specialized auxiliary ports may also be included in connector plate 141, such as one or more ports directed toward the transmission of power or other elements, such as plasma or coolant, as desired. In a preferred embodiment, a plurality of power transmission ports are provided, such that a base level of power can be transmitted across a first power port, while top boxes that require unusually large amounts of power can receive additional power through the use of one or more added power ports. In this manner, one or more of these multiple power ports will typically be unused for a given gaming machine. Similarly, it is contemplated that some or many of the 100 or so ports on a standardized connector plate will go unused for any given gaming machine, since many of the ports can simply function as placeholders for the rare top box that requires, for example, 4 separate DVI ports, or 16 separate analog ports. Of course, a similar mating connector plate (not shown) is positioned on the abutting face of top box 111, such that these standardized connector plates with mating connection ports or connections can fit into or against each other when the top box is installed on the gaming machine.

As seen in FIG. 2C, another possible permutation for a gaming machine having a universal top box engine finds the universal top box engine 140 staying with the top box 111 as it is removed from the main cabinet 112 and remainder of gaming machine 102. As in the prior permutation, one or more of the major components can be adapted such that a physical "docking station" is created for the convenient removal and insertion of top box 111 and universal top box engine 140 or another similarly adapted top box and universal top box engine, with such an adaptation also involving any number of rails, guides, sliders, grooves, dowels, wheels, pins, holes, clamps, latches, locks and/or other suitable docking type items (not shown) on the top box, the main cabinet, the universal top box engine, or any combination of these major components, as desired. Similarly, although it is possible for universal top box engine 140 to be integrated with or permanently attached to top box 111, it is again preferable that these two items also be separable from each other.

Similar to the previous permutation, a standardized hardware interface, such as an electrical plate or grid, legacy plug or other suitable communication plate (not shown) can be built into a side or the bottom of the universal gaming engine 140, with a mating hardware interface similarly built into the abutting side or top of the main cabinet 112. Such an interface can be a Smart Interface or Full Interface, as in the prior permutation. As shown in FIG. 2C, main cabinet to universal top box engine connector plate 142 can be a standardized grid of communication ports or connections, along with a ported connection to transmit power from the universal top box engine to the top box. As before, such a connector plate can contain any number of individual communication ports or connections, such as, for example, on the order of about 100 such ports, such that more specific instructions for individual peripheral devices or items on the top box can be transmitted directly from the universal gaming engine. These individual ports or connections are again preferably organized according to a general standard, such that similar devices should always or usually connect to the same port.

Alternatively, main cabinet to universal top box engine connector plate 142 can be a more streamlined Smart Interface with only a handful of connections, or even a simpler communication interface having just one or two connections. This might be especially preferable where the MGC is contained in the main cabinet and a separate dedicated processor, such as a CPU, is contained in the universal top box engine, such that comprehensive communications from the MGC to the universal top box engine and/or top box are mostly or completely processed by the universal top box engine CPU. Such a substantially simpler interface can more readily facilitate the removal and remounting of top boxes from gaming machine 102. Under such an embodiment or permutation, a communication buffer or layer such as an application program interface (API) can be established between the main cabinet and the universal top box engine, the implementation of which will be readily appreciated by those skilled in the art.

In both permutation 101 and permutation 102 of gaming machine 100, it is preferable that each of top box 111, universal top box engine 140 and main cabinet 112 be detachable from both of the other components. That is, the universal top box engine of permutation 101 in FIG. 2B can also detach from the main cabinet, and the universal top box engine of permutation 102 in FIG. 2C can also detach from the top box. In such instances it is preferable that additional docking elements be present on each major component to facilitate such further detachments. Further, it is also preferable that both connector plate 141 and connector plate 142 be present, as well as the mating counterparts not illustrated in FIGS. 2B and 2C. In this manner, each of these three major gaming machine components can be developed, manufactured, tested, purchased, shipped and installed separately.

It is also particularly preferable that the focus of direct control for the top box 111 and all or most of the peripheral devices found within or on the top box be set within the universal top box engine, and specifically within one or more dedicated processing units within the universal top box engine. By placing such primary control at the top box engine, rather than at the MGC or other closely related component, it is possible for the MGC to have a unified and streamlined operating system with respect to top box operations, whereby one comprehensive driver is used for all top box peripherals, as opposed to the standard implementation of a half-dozen to two dozen or more separate small drivers. Such a comprehensive operating system can be, for example, Windows CE Embedded, Windows XP, Linux, Monta Vista Linux, QNX, or any other suitable operating system, as will be readily appreciated.

Figure 3:
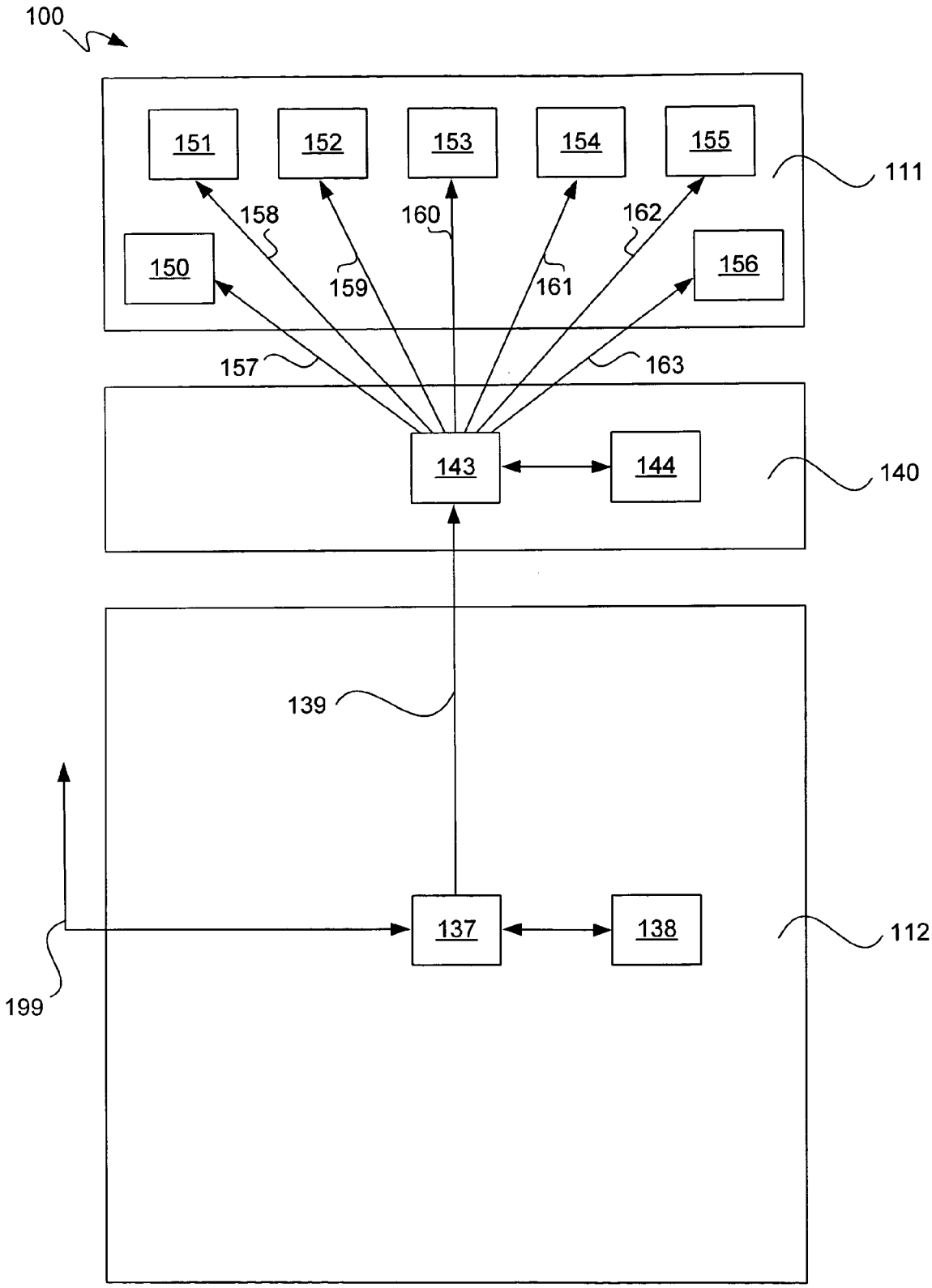
FIG. 3 illustrates a block diagram of an exemplary electronic component infrastructure for the alternative gaming machine having an interchangeable top box and universal top box engine of FIGS. 2A through 2C according to one embodiment of the present invention.

Referring to FIG. 3, an exemplary electronic component infrastructure for the alternative gaming machine shown in FIGS. 2A through 2C is illustrated in a block diagram format. As illustrated, gaming machine 100 is broken into three major components, main cabinet 112, universal top box engine 140 and top box 111. Main cabinet 112 contains numerous items and devices, notably a MGC 137 and one or more associated storage units or memory devices 138, which can be, for example, ROM, flash RAM, dynamic RAM, a hard drive, any other practicable type of memory or data storage, or any combination thereof, as desired. A communication link 199 may connect the MGC 137 with an outside system, network or server (not shown), and this link can be selected from a variety of suitable connections, such as one or more wireless or hardwired connections, one-way buses, bidirectional buses, and the like. Of course, such a link need not connect directly to the MGC, as a communications board or one or more other intermediary components may also be installed. A direct communication link 139 between the MGC and the universal top box engine 140 can similarly be selected from a variety of suitable connections, such as one or more wireless or hardwired connections, one-way buses, bidirectional buses, and the like. As noted above, such a connection may be detachable at mating hardware interfaces (not shown in FIG. 3) between the main cabinet 112 and the universal top box engine. As also noted above, a communication layer such as an API is preferably established between the main cabinet and the universal top box engine. It will also be appreciated that while MGC 137 is shown as being located within main cabinet 112, it is also possible for the MGC to be located in other places about or within gaming machine 100, such as, for example, inside the universal top box engine itself.

Universal top box engine 140 also contains numerous items and devices, notably at least one dedicated processing unit, such as a CPU 143, and one or more associated storage units or memory devices 144, which again can be, for example, ROM, flash RAM, dynamic RAM, a hard drive, any other practicable type of memory or data storage, or any combination thereof, as desired. This CPU 143 is particularly adapted so as to receive communications and commands from the gaming machine MGC, to process these commands itself or through other processors and/or devices within the universal top box engine, and then issue commands to, communicate with and control many or all of the peripheral devices contained on top box 111. Several communication links 157-163 between the universal top box engine 140 and various peripheral devices 150-156 contained within or on top box 111 are present, and as also noted above, such connections are detachable at mating hardware interfaces (not shown in FIG. 3) between the universal top box engine and the top box.

Top box 111 contains numerous items and devices itself, with peripheral devices 150-156 being shown here for purposes of illustration. It will be understood that the present illustration is merely a simplified block diagram, and that many more items and peripheral devices may be present on a given top box. It will also be appreciated that any or all of such additional items or peripheral devices on the top box may also be controlled by the CPU 143 of the universal top box engine, as desired. Presenting known examples of top box peripheral devices for purposes of illustration, such devices can include, for example, a secondary or tertiary video display 150, which may include a separate display controller, one or more speakers 151, for which an audio amplifier may be included, various individual bulbs or lights 152, which may require a separate serial light controller, a separate progressive jackpot display 153, which may require its own specialized controller, a ticket printer 154 and printer controller, a stepper motor 155 and motor controller, and a generic top box peripheral device 156. Such a generic device can be any other top box peripheral as desired, such as a player tracking unit, for example. Such a player tracking unit 156 may include a dedicated memory unit configured to store various items, such as, for example, player tracking software or other data collection software, device drivers for many types of player tracking devices, and communication protocols (e.g., TCP/IP) that allow the player tracking unit to communicate with other devices, among others. Other details of implementing a player tracking unit or system on a gaming machine are described in commonly assigned and co-pending U.S. patent application Ser. No. 09/838,033, by Criss-Puszkiewicz, et al. filed on Apr. 19, 2001, and entitled "Universal Player Tracking System," which application is incorporated herein in its entirety and for all purposes.

Top box peripheral devices 150-156 are all in communication with the universal top box engine 140 via various communication links or modes 157-163. While only seven specific links or modes are shown for purposes of clarity, it will be appreciated that many more may be present, such as, for example, 100 or so individual communication links or modes. Also, while it is preferable for each top box peripheral device to have its own separate communication link or line to the universal top box engine, it will be appreciated that similar peripheral devices and even differing peripheral devices utilizing the same or similar communication protocols can be connected along the same transmission link, line or bus. It is also specifically contemplated that any peripheral device that can possibly be placed within or on a top box can be accounted for via such a link across the standardized communication interface as disclosed herein. To account for irregular devices or future developments, it is therefore preferable that one or more ports on such an interface be irregular, oversized, or left open for future development efforts.

Moving on and presenting specific examples of communication lines and modes between universal top box engine 140 and the various peripheral devices contained within or on top box 111 within the simplified context of FIG. 3, each of lines 157-163 is shown as corresponding to a top box peripheral device on a one-to-one basis. For example, link 157 connects to additional video display 150 and possibly a dedicated video controller, such that link 157 can be a DVI type line. Meanwhile, link 158 connects to one or more speakers 151 and possibly an audio amplifier therefor, and can thus be an analog line. Further, link 159 connects to a series of various individual bulbs or lights 152 and possibly a separate serial light controller also, such that link 159 can be a custom serial line. Link 160 connects to a separate progressive jackpot display 153 and possibly a specialized display controller, such that link 160 can be a Netplex type communication line. Next, link 161 connects to a ticket printer 154 and printer controller, for which an RS-232 line would be appropriate. Link 162 connects to a stepper motor 155 and motor controller, such that a link 162 can be a USB type of line. Finally, link 163 connects to a generic top box peripheral device 156, such that any other communication link or line suitable for use in a gaming machine would be appropriate. In the specific example where generic device 156 is a player tracking unit, link 163 could be an Ethernet line, for example.

Again, it will be readily appreciated that the foregoing examples are merely a small sample of the number of devices, number of links and types of communication protocols that can be present. It is preferable that some or all of such links be of one or another standard peripheral communication type, several examples of which are given in the foregoing illustrative discussion. Further details of using a standard peripheral communication connection within a gaming machine are described in commonly assigned U.S. Pat. No. 6,251,014, issued Jun. 26, 2001, to Stockdale, et al., and entitled "Standard Peripheral Communication," which patent is incorporated herein in its entirety and for all purposes. In a particularly preferred embodiment, many or all of the peripheral devices in or on top box 111 to be of a single communication type, such as, for example, all USB type devices, the various advantages of which will be readily appreciated. Examples of gaming machine systems that implement and control multiple USB devices and re-use various drivers and code therefor are described in commonly assigned and co-pending U.S. patent application Ser. No. 10/460,822, by Lam, et al. filed on Jun. 11, 2003, and entitled "USB Software Architecture In A Gaming Machine," which application is incorporated herein in its entirety and for all purposes.

In another embodiment (not shown), it is specifically contemplated that an additional CPU or processor be placed within the top box itself, such that top box engine CPU 143 communicates directly with this additional processing unit within the top box. Such a relationship can be especially beneficial in the event that a "Smart Interface" with a reduced number of ports or connections between the universal top box engine and the top box is implemented. Such a use can also result in the top box 111 becoming a "smart peripheral" in that one processor within the top box controls and directs activity within the top box, while the entire top box is removable with respect to the remainder of the gaming machine. In yet another embodiment, top box engine CPU 143 can be located within the top box itself, such that the top box 111 and universal top box engine 140 essentially comprise one unit. In this manner, the general "star" topology in communications between the top box and the remainder of the gaming machine can essentially be converted to a more "bus" like topology. In addition, a common bus or other communication line (not shown) may also be installed, such that additional modes of communication across gaming machine 100 are possible. Such a possibility is illustrated in further detail in other embodiments below.

Figure 4:
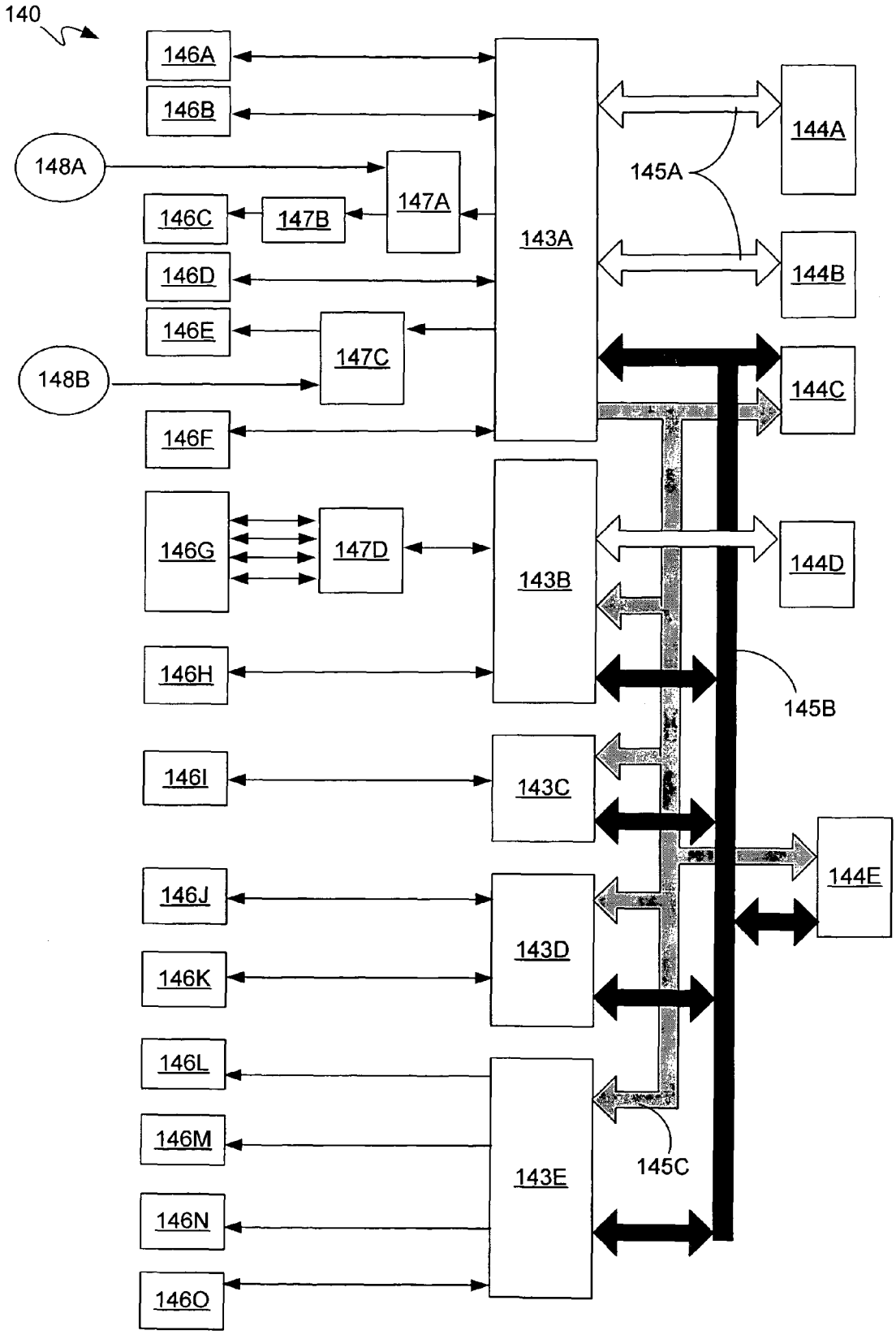
FIG. 4 illustrates a block diagram of an exemplary detailed electronic infrastructure for the universal top box engine of FIGS. 2A through 2C according to one embodiment of the present invention.

FIG. 4 illustrates a block diagram of an exemplary detailed electronic infrastructure for the universal top box engine of FIGS. 2A through 2C according to one embodiment of the present invention. As shown, universal top box engine 140 comprises at least one extensive multimedia board having numerous processors, drivers, memory units and other assorted devices. It will be readily understood that the present invention is not limited to this or any other multimedia board, and that this detailed board is presented for illustrative purposes only. In particular, it will be readily appreciated that many units of varying sizes, speeds and/or capacities may be substituted for those provided in the following illustrative example, with many such substitutions potentially resulting in a better product. For example, a 256 MB SDRAM device could be inserted in place of the provided 128 MB SDRAM device to double the capacity of that device. As such, the following detailed embodiment is merely a specific one as contemplated by the present inventors, with many other multi-interface boards also being adequate for use in the present invention. Another example of a multi-interface board on a gaming machine is described in commonly assigned and co-pending U.S. patent application Ser. No. 10/246,373, by Hedrick, et al. filed on Sep. 16, 2002, and entitled "Player Tracking Communication Mechanisms In A Gaming Machine," which application is incorporated herein in its entirety and for all purposes.

In the particular embodiment shown, universal top box engine 140 contains several dedicated processors 143A-143E, at least one of which is a CPU for the universal top box engine. Such a CPU may be an x86 compatible system on a chip 143A, which chip may also include MMX support, a CRT, a TFT video processor, an NTSC/PAL TV encoder, core logic, a Video Port (VIP) and a Super I/O block, among other items. In a preferred embodiment, however, this CPU chip 143A is an Intel PXA250 X-scale processor, which can operate at up to 400 Mhz and dissipate less than one watt of power. Examples of other dedicated processing units with varying functionalities can include, for instance, an SA-1111 chip 143B, a 10/100 Ethernet type chip 143C, a DUART unit 143D and any suitable FPGA 143E.

Associated with one or more of this series of dedicated processing units are memory devices 144A-144B. Primary proprietary memory devices associated only with the CPU 143A can include a 128 MB SDRAM device 144A and a Secure Digital Card I/F 144B. Another proprietary memory device associated only with the SA-1111 unit 143B can be a Compact Flash I/F or similar device 144D. Other memory devices designed as commonly available for one or more processing units can include, for example, a 16 MB FLASH unit 144C and a 128 KB FERAM unit 144E. Each of these memory devices is available over one or more communication links or buses 145A-145C between the dedicated processing units and associated storage units. Several of such links 145A are proprietary dedicated connections between a specific dedicated processor and its dedicated associated memory unit. Others comprise either a common two-way bus 145B between multiple processors and memory units, or a common one-way bus 145C from CPU 143A to multiple other processors and memory units.

Of significant importance are the various individual and specific ported connections 146A-146O to and from the universal top box engine 140. Although a significant handful of such ported connections are illustrated here, it will be readily appreciated that more connections and a greater variety of different types not shown here may also be similarly implemented. These various ported connections can include, for example, a USB Slave port 146A, a serial port 146B, and LCD port 146C, a debug port 146D, an audio amplifier port 146E, an I2C port 146F, 4 USB host ports 146G, a Kbd/Mouse port 146H, an Ethernet port 146L, Netplex Slave and Master ports 146J, 146K, two Serial spectrum ports 146L, two LED Attract ports 146M, a Ballast Control output, 146N and a Motor Control output 146O.

In addition, a plurality of intermediary devices 147A-147E between these specific ported connections and the respective dedicated processing units are provided. These can include, for example, Multiplexer and LVDS (low voltage, differential signal) units 147A, 147B for the LCD, a Codec (code and decode) A/D device 147C for the audio amplifier, and a USB hub 147D for the USB ports. Other intermediary units may also be present, and many such items that are typically present, such as a magnetic coupling unit for the Ethernet port, are not shown for purposes of simplicity. It is also specifically contemplated that one or more secondary sources also be able to provide input to one or more peripheral devices on the top box, such that the universal top box engine has high level or partial control or input to some of these peripheral devices. Such secondary inputs can include, for example, a separate Video In source 148A and a separate Audio In source 148B, which are adapted to run through the Multiplexer and Codec A/D units respectively. In this manner, the universal top box engine still controls and provides input for many or substantially all of the peripheral devices on the top box, while still advantageously allowing for the ability to have additional outside sources provide video, audio and other inputs to various devices and components within or on the top box, as desired.

As will be readily apparent from the foregoing list of included devices, the universal top box engine may provide a number of video display functions, such as a hardware video accelerator for scaling, filtering and color space conversion, as well as support for a number of video interfaces, such as but not limited to, 1) a CRT-Interface (VGA), 2) a TFT-Interface, and 3) a TV-Interface (TV-Out). Also included are one or more audio/video decoders to support streaming video applications and to support fast decoding of digitally encoded video files and audio files. Such video and/or audio decoders are designed to recognize a digital bit stream encoded in a particular format. Music and video files may be encoded in a number of digital file formats as specified according to a given standard that defines a bit stream syntax and decoder semantics. To be compliant with a particular standard, such as a digital video standard, the decoder implementation needs to correctly interpret the meaning of bits and render the associated image. To increase processing speed, logic for a video decoder or audio decoder may be integrated directly into hardware or software on the universal top box engine, as desired. Other features and abilities that may be present through these or other potential items present on universal top box engine may be referenced from any of the several incorporated references recited herein.

Pertinent functionalities and features worth listing here include the ability to create a Motor Control Network to allow stepper motor control interfaces to be attached via a serial control channel across the standardized hardware interfaces. Such control could be for two uni-polar motors or motor systems as well. Also, a serial shift interface can be implemented to control up to 1024 "attraction" LEDs or similar units. Such an interface could use a high-speed self-refreshing RS-485 signaling method involving a dual port RAM, for example. Alternatively, a serial shift interface could be implemented to control up to 512 attraction LEDs, 64 seven segment displays, or a combination thereof. Such a serial shift interface could be provided by either an RS-232 style interface or an RS-485 type interface similar to the 1024 bit serial shift interface, selection of which would not be dynamic. Preferably such selection would be via hardware configuration control mechanisms, with the software interface again being by way of a dual port RAM method.

Two additional serial shift interfaces could be implemented to control the Spectrum arrays, which interfaces could use shift methods identical to those used for the attraction LED interfaces. A set of control registers would allow these interfaces to be reprogrammed to look identical to the attraction LED interfaces in the event that the Spectrum interfaces are not required for a given top box. Power control can be provided using up to four fluorescent ballasts, with one or more methods to control power to the ballasts preferably being implemented in an effort to reduce overall power consumption in the gaming machine. Such an implementation can involve a simple bit style interface or the I2C interface, as desired. The I2C communications bus, which can preferably be optically isolated, can be adapted to provide a method for user input via I2C compatible input buffers. In addition, the I2C bus can be distributed within the top box such that additional devices can be attached, such as a temperature sensor adapted to monitor the temperature of the top box at one or several locations.

As noted throughout this disclosure, many "smart" peripheral interfaces are also preferably provided via the universal gaming engines disclosed herein. These can include, for example, a dedicated RS-232 serial port, which general-purpose port can be used to attach a peripheral device with its own control processor. Such a port could provide a standard low speed serial link to another peripheral device as well. Another "switchable" serial port can be provided that would support RS-232 or Netplex master signaling. Such a port could be for a single peripheral device or for several serial devices, which would allow the attachment of multiple intelligent or legacy Netplex peripheral devices. In addition, the provision of a number of USB compatible peripheral interfaces (for example, four as disclosed herein) allows the attachment of multiple intelligent USB peripherals, providing a virtually unlimited amount of peripheral expansion within the top box. Should there be a need for more than four USB peripherals in one top box (or more than USB ports provided), then a USB hub device could be used to expand the number of peripheral devices up to the theoretical maximum of 127, if desired.

Additional communication channels are also preferably provided, with such additional channels including, for example, at least one dedicated Netplex slave serial port, at least one dedicated USB peripheral port, and at least one Ethernet port. All existing and future versions and speeds for such Netplex, USB, Ethernet and other type ports are contemplated for use with the present invention. Such additional ports and communication channels provide a wider variety of options and functionalities for the various devices that may be present in any given top box, as will be readily appreciated. It will also be understood that many more port and communication channel types may also be used, depending upon the level of support desired across a wide variety of compatible top boxes and universal top box engines.

Figure 5A:
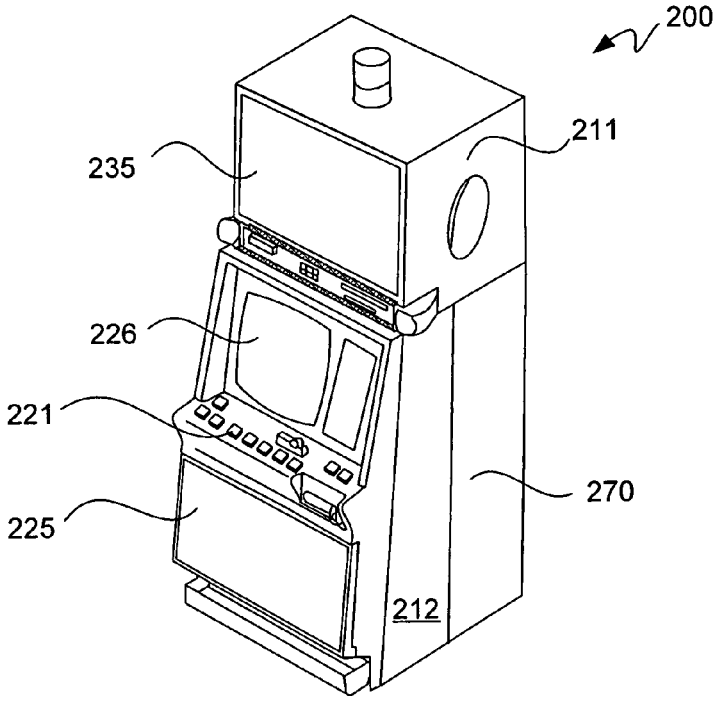
FIGS. 5A through 5C illustrate in perspective view another alternative gaming machine having an interchangeable main cabinet and universal main cabinet engine according to one embodiment of the present invention.
Figure 5B:
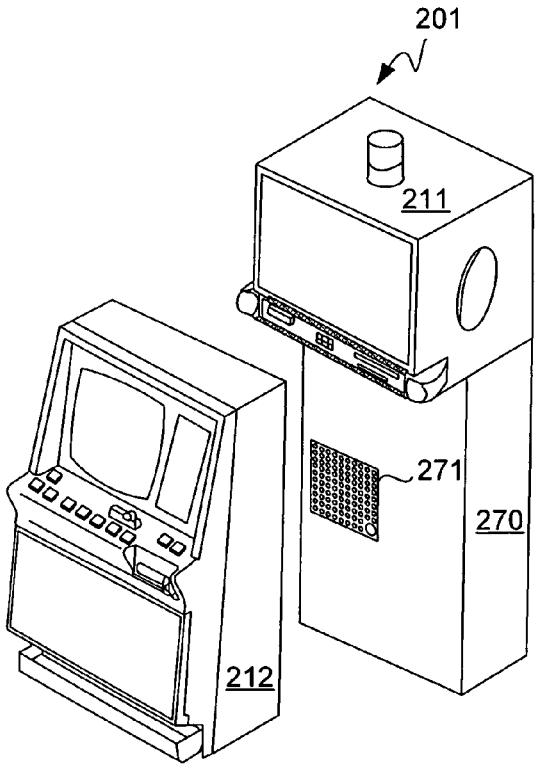
Figure 5C:
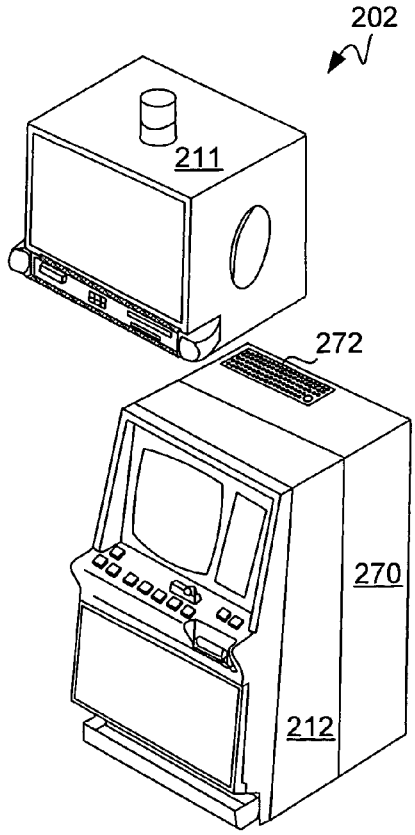

Turning now to FIGS. 5A through 5C, another alternative gaming machine having an interchangeable main cabinet and universal main cabinet engine according to one embodiment of the present invention is illustrated in perspective view. Similar to other gaming machines illustrated and discussed herein, alternative gaming machine 200 is also a gaming device that is generally adapted for accepting wagers from and granting monetary awards to players. Much like foregoing gaming machine 100, alternative gaming machine 200 is also illustrated as generally box-like, although such a difference is considered insubstantial for purposes of the present invention. Again, it is specifically contemplated that every inventive embodiment disclosed herein can be used in conjunction with all gaming machines of any shape or size, with appropriate adaptations or adjustments made as necessary.

As in the previous examples, gaming machine 200 includes a top box 211 and a main cabinet 212, both of which have a number of features substantially similar to those found in the previous gaming machine, such as, for example, one or more player-input switches or buttons 221, a belly glass 225, a primary video display monitor 226, and a secondary video display monitor 235, among others. As will again be readily appreciated, not all of the foregoing exemplary features are necessary and many other features or items not illustrated may also be present or used in place of any of the features that are shown for purposes of the present invention. Unlike any of the foregoing examples, however, main cabinet 212 is removable from gaming machine 200, and can be interchanged with numerous other main cabinets that are similarly adapted to attach to this particular gaming machine. Such other main cabinets can be substantially similar to main cabinet 212, or, significantly, can be of different shapes, sizes and/or game themes, and can contain fewer, more or different peripheral devices having differing functionalities than those of main cabinet 212.

To facilitate the removal and interchangeability of its main cabinet, gaming machine 200 also includes a universal gaming engine, specifically a universal main cabinet engine 270. Main cabinet 212 can then be tested, repaired, upgraded or otherwise altered while separate from the remainder of gaming machine 200, and then put back into place on the gaming machine. Alternatively, a different main cabinet with identical, similar, or substantially different parts and components can be put into place on gaming machine 200. Similar to the foregoing embodiment for a universal top box engine and removable top box, universal main cabinet engine 270 contains a number of components and features that enable the modular removal of main cabinet 212. Various components and features of universal main cabinet engine 270 that permit and facilitate the removal and interchangeability of various top boxes can again include, for example, a standardized software interface, one or more software and hardware interface mediators, at least one dedicated processor, one or more associated storage devices, a universal hardware engine, simplified and standardized wirings and wiring systems, one or more external physical docking components, and a standardized hardware interface, such as a legacy plug or electrical plate or grid, among others.

In a preferred embodiment, universal main cabinet engine 270 is a stand-alone component that attaches to a main cabinet and at least one other major gaming machine component, such as a top box or another universal gaming engine. As in the prior example, this universal main cabinet engine is adapted such that bi-directional communications are possible with one or more components to which it attaches. For example, as illustrated in FIG. 5A, bi-directional communications are possible between top box 211 and universal main cabinet engine 270, as well as between main cabinet 212 and the universal main cabinet engine. Such an arrangement can allow for the independent testing of not only the universal main cabinet engine, but also of every top box and main cabinet that is adapted to interface with this universal main cabinet engine. Accordingly, both top box 211 and main cabinet 212 can be developed as separate stand-alone major components of a gaming machine. Again, this enables different teams of developers to create major components for a newly designed gaming machine independently and in a quicker manner with fewer complications than typically arise in custom designed main cabinets and other major components.

As seen in FIG. 5B, one possible permutation for a gaming machine having a universal main cabinet engine has the universal main cabinet engine 270 remaining with the top box 211 as the main cabinet 212 is removed from the gaming machine 201. As in the foregoing examples involving a universal top box engine, one or more of the major components can be adapted such that a physical "docking station" is created for the convenient removal and insertion of main cabinet 212 or another similarly adapted main cabinet. Such an adaptation can again involve placing any number of rails, guides, sliders, grooves, dowels, wheels, pins, holes, clamps, latches, locks and/or other suitable docking type items (not shown) on the top box, the main cabinet, the universal main cabinet engine, or any combination of these major components, as desired. Also, although it is possible for universal main cabinet engine 270 to be integrated with or permanently attached to top box 211, it is preferable that these two items also be separable from each other.

As in the previous examples, a standardized hardware interface, such as an electrical plate or grid, legacy plug or other suitable communication plate is preferably built into a side of the universal main cabinet engine 270, with a mating hardware interface (not shown) similarly built into the abutting side of the removable main cabinet 212. As before, such an interface can be a Smart Interface or a Full Interface, with both of those possibilities being substantially similar to those types of interfaces as described above. As shown in FIG. 5B, universal main cabinet engine to main cabinet connector plate 271 is a standardized grid of communication ports or connections, along with a ported connection to transmit power from the universal main cabinet engine to the main cabinet. Again, such a connector plate can contain, for example, 100 or so individual communication ports or connections, such that more specific instructions for individual peripheral devices or items on the main cabinet can be transmitted directly from the universal main cabinet engine. As before, these individual communication ports or connections are preferably organized according to a standard, such that similar devices should always or usually connect to the same port. Other details and examples for this interface can similarly be transported from the interface disclosed above for the universal top box engine embodiments.

As seen in FIG. 5C, another possible permutation for a gaming machine having a universal main cabinet engine finds the universal main cabinet engine 270 staying with the main cabinet 212 as it is removed from the top box 211 and any other remainder of gaming machine 202. As in the prior permutation, one or more of the major components can be adapted such that a physical "docking station" is created for the convenient removal and insertion of main cabinet 212 and universal main cabinet engine 270 or another similarly adapted main cabinet and universal main cabinet engine, with such an adaptation also involving any number of docking or connecting items on any or all major components, as are listed above. Similar to previous embodiments and permutations, although it is possible for universal main cabinet engine 270 to be integrated with or permanently attached to main cabinet 270, it is again preferable that these two items also be separable from each other.

Again, a standardized hardware interface, such as an electrical plate or grid, legacy plug or other suitable communication plate can be built into a side or the top of the universal main cabinet engine 270, with a mating hardware interface similarly built into the abutting side or bottom of the top box 211, and such an interface can be a Smart Interface or Full Interface, as in the prior permutations. As shown in FIG. 2C, universal main cabinet engine to top box connector plate 272 can be a standardized grid of communication ports or connections, along with a ported connection to transmit power from the universal top box engine to the top box. As before, such a connector plate can contain any number of individual communication ports or connections, such as, for example, on the order of about 100 such ports, such that more specific instructions for individual peripheral devices or items on the top box can be transmitted directly from the universal gaming engine. These individual ports or connections are again preferably organized according to a general standard, such that similar devices should always or usually connect to the same port. Alternatively, universal main cabinet engine to top box connector plate 272 can be a streamlined Smart Interface with only a handful of connections, or even a simpler communication interface having just one or two connections. Such a substantially simpler interface can more readily facilitate the removal and remounting of top boxes from gaming machine 202.

In both permutation 201 and permutation 202 of gaming machine 200, it is preferable that each of top box 211, universal main cabinet engine 270 and main cabinet 212 be detachable from both of the other major components. That is, the universal main cabinet engine of permutation 201 in FIG. 5B can also detach from the top box, and the universal main cabinet engine of permutation 202 in FIG. 5C can also detach from the main cabinet. Again, in such instances it is preferable that additional docking elements be present on each major component to facilitate such further detachments. Further, it is also preferable that both connector plate 141 and connector plate 142 be present, as well as the mating counterparts not illustrated in FIGS. 5B and 5C. In this manner, each of these three major gaming machine components can be manufactured, tested, purchased, shipped and installed separately.

It is also particularly preferable that the focus of direct control for the main cabinet 212 and all or most of the peripheral devices found within and on the main cabinet be set within the universal main cabinet engine, and specifically within one or more dedicated processing units within the universal main cabinet engine. By placing such primary control at the universal main cabinet engine, rather than at the MGC or other closely related component, it is possible for the MGC to have a unified and streamlined operating system with respect to main cabinet operations, whereby one comprehensive driver is used for all main cabinet peripherals, as opposed to the standard implementation of a half-dozen to two dozen or more separate small drivers. As above, such a comprehensive operating system can similarly be, for example, Windows CE Embedded, Windows XP, Linux, Monta Vista Linux, QNX, or any other suitable operating system, as will be readily appreciated.

Figure 6:
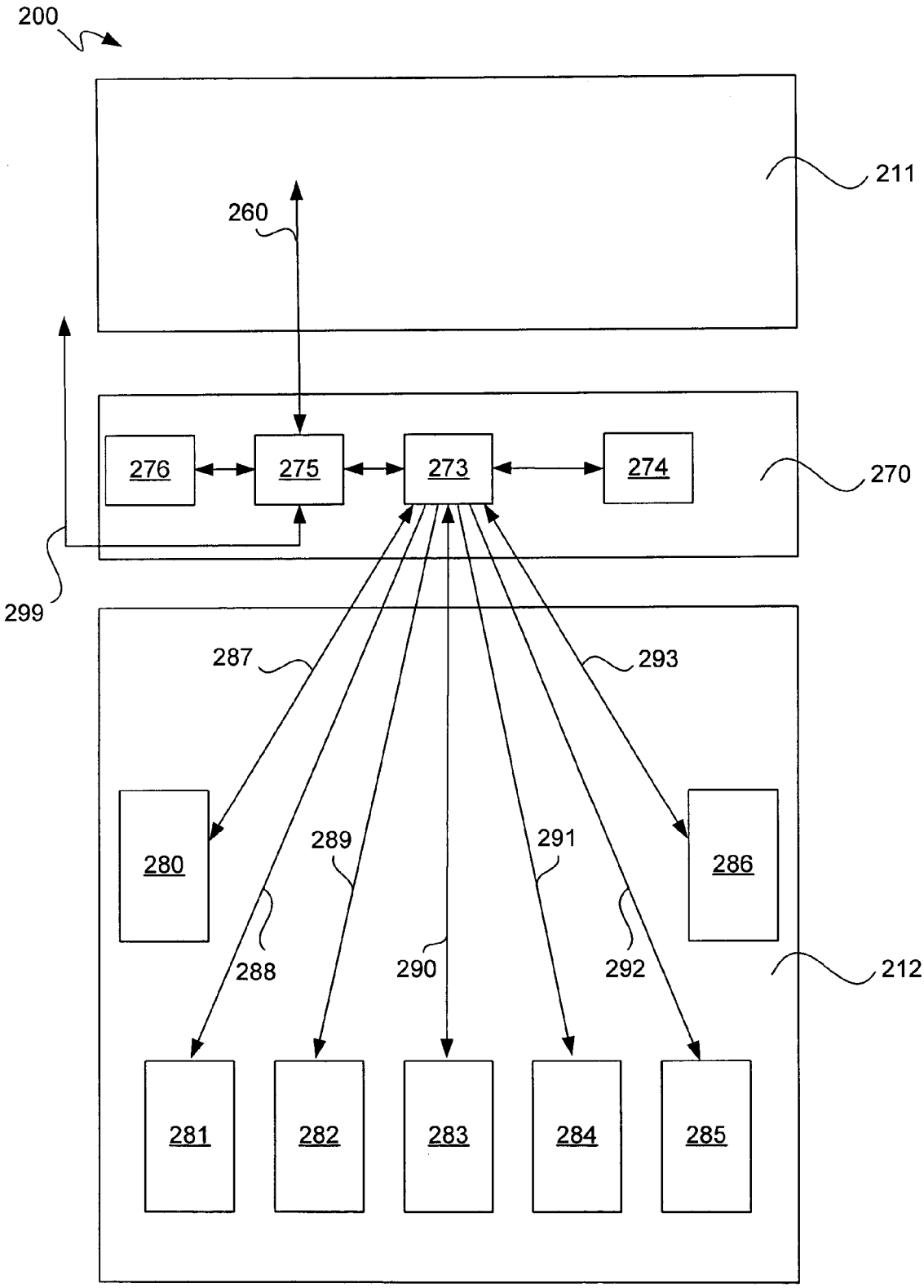
FIG. 6 illustrates a block diagram of an exemplary electronic component infrastructure for the alternative gaming machine having an interchangeable main cabinet and universal main cabinet engine of FIGS. 5A through 5C according to one embodiment of the present invention.

Referring now to FIG. 6, an exemplary electronic component infrastructure for the alternative gaming machine shown in FIGS. 5A through 5C is illustrated in a simplified block diagram format. As illustrated, gaming machine 200 is again broken into three major components, main cabinet 212, universal main cabinet engine 270 and top box 211. While top box 211 preferably includes a plurality of devices and items, such devices and items are not shown for purposes of clarity in discussing the main cabinet and universal main cabinet engine. Accordingly, only a single generic communication line 260 is shown connecting top box 211 with universal main cabinet engine 270, and in particular MGC 275. As in the prior embodiment, a communication link 299 may connect the MGC 275 with an outside system, network or server (not shown), with this link being similarly selected from a variety of suitable connections, such as one or more wireless or hardwired connections, one-way buses, bidirectional buses, and the like. Of course, such a link need not connect directly to the MGC, as a communications board or one or more other intermediary components may also be installed. In this embodiment, MGC 275 is included within the main cabinet engine 270, which thus acts as a base unit, to better facilitate the nature of main cabinet 212 as a removable and interchangeable modular unit. It will be readily appreciated that this MGC may also be housed in the removable main cabinet itself, with reorganization and rewiring of components made as appropriate.

In addition to MGC 275 and at least one associated storage unit or memory device 276, the universal main cabinet engine also includes at least one dedicated processing unit 273, such as a CPU, which is adapted to control some or all of the peripheral devices located within or on main cabinet 212. This engine CPU 273 is particularly adapted so as to receive communications and commands from the gaming machine MGC 275, to process these commands itself or through other processors and/or devices within the universal main cabinet engine, and then issue commands to, communicate with and control many or all of the peripheral devices contained within or on main cabinet 212. At least one associated storage unit or memory device 274 is included for use in conjunction with gaming engine CPU 273. As in the foregoing examples, these storage units or memory devices 274, 276 can be selected from any suitable type of storage unit, such as, for example, ROM, flash RAM, dynamic RAM, a hard drive, any other practicable type of memory or data storage, or any combination thereof, as desired. Several communication links 287-293 between the universal main cabinet engine 270 and various peripheral devices 280-286 contained within or on main cabinet 212 are present, and as also noted above, such connections are detachable at mating hardware interfaces (not shown in FIG. 6) between the universal main cabinet engine and the main cabinet.

Main cabinet 212 contains numerous items and devices itself, with peripheral devices 280-286 being shown here for purposes of illustration. As in the case of the universal top box embodiment above, it will be understood that the present illustration is merely a simplified block diagram, and that many more items and peripheral devices may be present on a given main cabinet. It will also be appreciated that any or all of such additional items or peripheral devices on the main cabinet may also be controlled by the gaming engine CPU 273, as desired. Presenting known examples of main cabinet peripheral devices for purposes of illustration, such devices can include, for example, a touchscreen and touchscreen display 280, a bezel light 281, an electronically provided or backlit pay table 282, a bill acceptor 283, a coin acceptor 284, a coin hopper 285, and a generic main cabinet peripheral device 286, which can be any other suitable main cabinet peripheral device. Of course, each of these peripheral devices may also come with an associated controller, which may be a dedicated controller for the specific peripheral device. Generic main cabinet peripheral device 286 can be, for example, a ticket printer, which may have its own separate controller.

Main cabinet peripheral devices 280-286 are all in communication with the universal main cabinet engine 270 via various communication links or modes 287-293. While only seven specific links or modes are shown for purposes of clarity, it will again be appreciated that many more may be present, such as, for example, 100 or so individual communication links or modes. Also, while it is preferable for each main cabinet peripheral device to have its own separate communication link or line to the universal main cabinet engine, it will be appreciated that similar peripheral devices and even differing peripheral devices utilizing the same or similar communication protocols can be connected along the same transmission link, line or bus. It is also specifically contemplated that any peripheral device that can possibly be placed within or on a main cabinet can be accounted for via such a link across the standardized communication interface as disclosed herein. Again, to account for irregular devices or future developments, it is therefore preferable that one or more ports on such an interface be irregular, oversized, or left open for future development efforts.

Presenting specific examples of communication lines and modes between universal main cabinet engine 270 and the various peripheral devices contained within or on main cabinet 270 within the simplified context of FIG. 6, each of lines 287-293 is shown as corresponding to a main cabinet peripheral device on a one-to-one basis. For example, link 287 connects to a touchscreen and touchscreen display 280 and possibly a dedicated video or touchscreen controller, whereby input would need to be relayed back to CPU 273, such that link 287 can be a USB line. Meanwhile, link 288 connects to one or more bezel lights 281 and possibly a separate controller therefor, and can thus be a custom serial line. Further, link 289 connects to a backlit or electronically provided pay table 282, such that link 289 can be an RS-232 line. Link 290 connects to a bill acceptor 283 and possibly a specialized controller for same, such that link 290 can be a Netplex type communication line. Next, link 291 connects to a coin acceptor 284, for which a custom serial line would be appropriate. Link 292 connects to a coin hopper 285 and appropriate controller, such that this link can be also be a custom serial type of line. Finally, link 293 connects to the generic top box peripheral device 286, such that any other communication link or line suitable for use in a gaming machine would be appropriate. In the specific example where generic device 286 is a ticket printer, link 293 could also be a serial line, for example.

Again, it will be readily appreciated that the foregoing examples are merely a small sample of the number of devices, number of links and types of communication protocols that can be present. It is preferable that some or all of such links be of one or another standard peripheral communication type, several examples of which are given in the foregoing illustrative discussion. As in the previous embodiment, many or all of the peripheral devices in or on main cabinet 212 can be of a single communication type, such as, for example, all USB type devices, the various advantages of which will be readily appreciated. Further details of using a standard peripheral communication connection within a gaming machine, as well as examples of gaming machine systems that implement and control multiple USB devices and re-use various drivers and code therefor are all described in various references as recited above.

Similar to the foregoing embodiment above, it is specifically contemplated that an additional CPU or processor be placed within the main cabinet itself, such that gaming engine CPU 273 communicates directly with this additional processing unit within the main cabinet. Such a relationship can be similarly beneficial in the event that a "Smart Interface" with a reduced number of ports or connections between the universal main cabinet engine and the main cabinet is implemented. Such a use can also result in the main cabinet 212 becoming a "smart peripheral" in that one processor within the main cabinet controls and directs activity within the main cabinet, while the entire main cabinet or at least a face portion thereof is removable with respect to the remainder of the gaming machine. In yet another embodiment, gaming engine CPU 273 can be located within the main cabinet itself, with the MGC 275 communicating directly with the gaming engine CPU 273 across an interface between the main cabinet and gaming engine. In addition, a common bus or other communication line (not shown) may also be installed, such that additional modes of communication across gaming machine 200 are possible. Such a possibility is illustrated in further detail in other embodiments below.

Figure 7A:
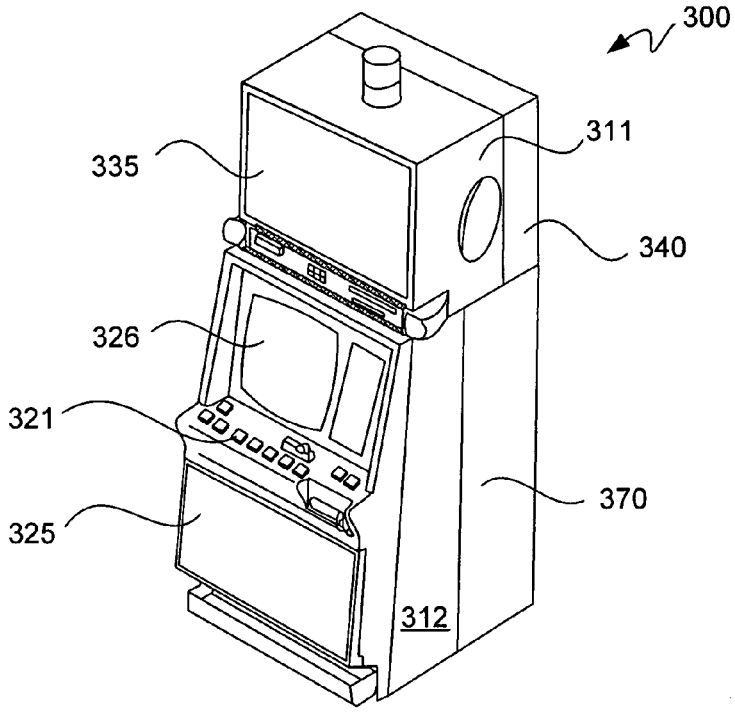
FIGS. 7A and 7B illustrate in perspective view yet another alternative gaming machine having an interchangeable top box, interchangeable main cabinet, universal top box engine and universal main cabinet engine according to one embodiment of the present invention.
Figure 7B:
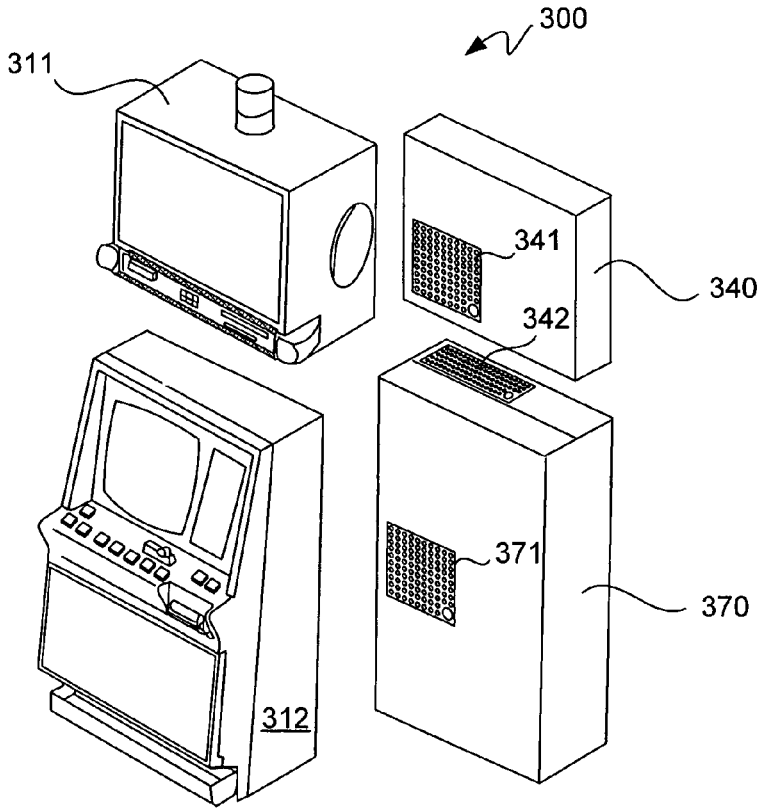

FIGS. 7A and 7B similarly illustrate in perspective view yet another alternative gaming machine having an interchangeable top box, interchangeable main cabinet, universal top box engine and universal main cabinet engine according to one embodiment of the present invention. Similar to each of the previously illustrated gaming machines, alternative gaming machine 300 is also a gaming device that is generally adapted for accepting wagers from and granting monetary awards to players. Much like foregoing gaming machines 100 and 200, alternative gaming machine 300 is also illustrated as generally box-like, although such a difference is again considered insubstantial, such that gaming machines of any shape or size can be used with this embodiment. As in the previous examples, gaming machine 300 includes a top box 311 and main cabinet 312 with a number of features substantially similar to those found in the previous gaming machine, such as, for example, one or more player-input switches or buttons 321, a belly glass 325, a primary video display monitor 326, and a secondary video display monitor 335, among others. As will again be readily appreciated, not all of the foregoing exemplary features are necessary and many other features or items not illustrated may also be present or used in place of any of the features that are shown for purposes of the present invention.

Unlike any of the foregoing examples, however, both top box 311 and main cabinet 312 are removable from gaming machine 300, and one or both can preferably be interchanged with numerous other top boxes and main cabinets that are similarly adapted to attach to this particular gaming machine.

Similar to the foregoing embodiments, such other top boxes and main cabinets can be substantially similar to top box 311 and/or main cabinet 312, or, significantly, can be of different shapes, sizes and/or game themes, and can contain fewer, more or different peripheral devices having differing functionalities than those of top box 311 and/or main cabinet 312. To facilitate the removal and interchangeability of its top box and/or main cabinet, gaming machine 300 also includes two universal gaming engines, specifically a universal top box engine 340 and a universal main cabinet engine 370. Both top box 311 and main cabinet 312 can then be tested, repaired, upgraded or otherwise altered while separate from the remainder of gaming machine 300, and then put back into place on the gaming machine. Alternatively, a different top box and/or different main cabinet with identical, similar, or substantially different parts and components can be put into place on gaming machine 300.

Similar to the foregoing embodiments discussed in detail above, universal top box engine 340 and universal main cabinet engine 370 both contain a number of components and features that enable the modular removal of the top box 311, main cabinet 312, or both. Such various components and features are identical or at least substantially similar to those detailed above, such that further repetition here is not necessary. As in the prior examples, both universal top box engine 340 and universal main cabinet engine 370 are stand-alone components that attach to one or more major gaming machine components, such as a top box, a main cabinet or another universal gaming engine. As also in the prior examples, each of these universal gaming engines are adapted such that bi-directional communications are possible with one or more major components to which it attaches. Various benefits inherent to this embodiment mirror those of the previously disclosed embodiments.

As seen in FIG. 7B, one possible permutation for a gaming machine having both a universal top box engine and a universal main cabinet engine has all four major components separable from each other. That is, the top box 311, universal top box engine 340, universal main cabinet engine 370, and main cabinet 312 can all be removed separately or as combined units from the gaming machine 300. As in the foregoing examples, one or more of these major components can be adapted such that physical docking stations are created for the convenient removal and insertion of any or all of these major components, with various features or components used for such an adaptation, as listed above. As in the previous examples, various standardized hardware interfaces, such as an electrical plates or grids, legacy plugs or other suitable communication plates are preferably built into a face of each removable major component, with a mating hardware interface similarly built into the abutting side of the adjoining major component. As before, such an interface can be a Smart Interface or a Full Interface, with both of those possibilities being substantially similar to those types of interfaces as described above.

As shown in FIG. 7B, each of universal top box engine to top box connector plate 341, universal main cabinet engine to universal top box engine connector plate 342, and universal main cabinet engine to main cabinet connector plate 371 is a standardized grid of communication ports or connections, along with a ported connection to transmit power from the universal main cabinet engine to the main cabinet. As before, one or more of such connector plates can contain, for example, 100 or so individual communication ports or connections, such that more specific instructions for individual peripheral devices or items can be transmitted directly from the appropriate controlling universal gaming engine. Again, these individual communication ports or connections are preferably organized according to a standard, such that similar devices should always or usually connect to the same port. Of course, other details, features and examples from the interfaces disclosed above for other embodiments can also apply, and it is specifically contemplated that a mixture of Smart and Full Interfaces can be used throughout gaming machine 300, as desired.

Figure 8A:
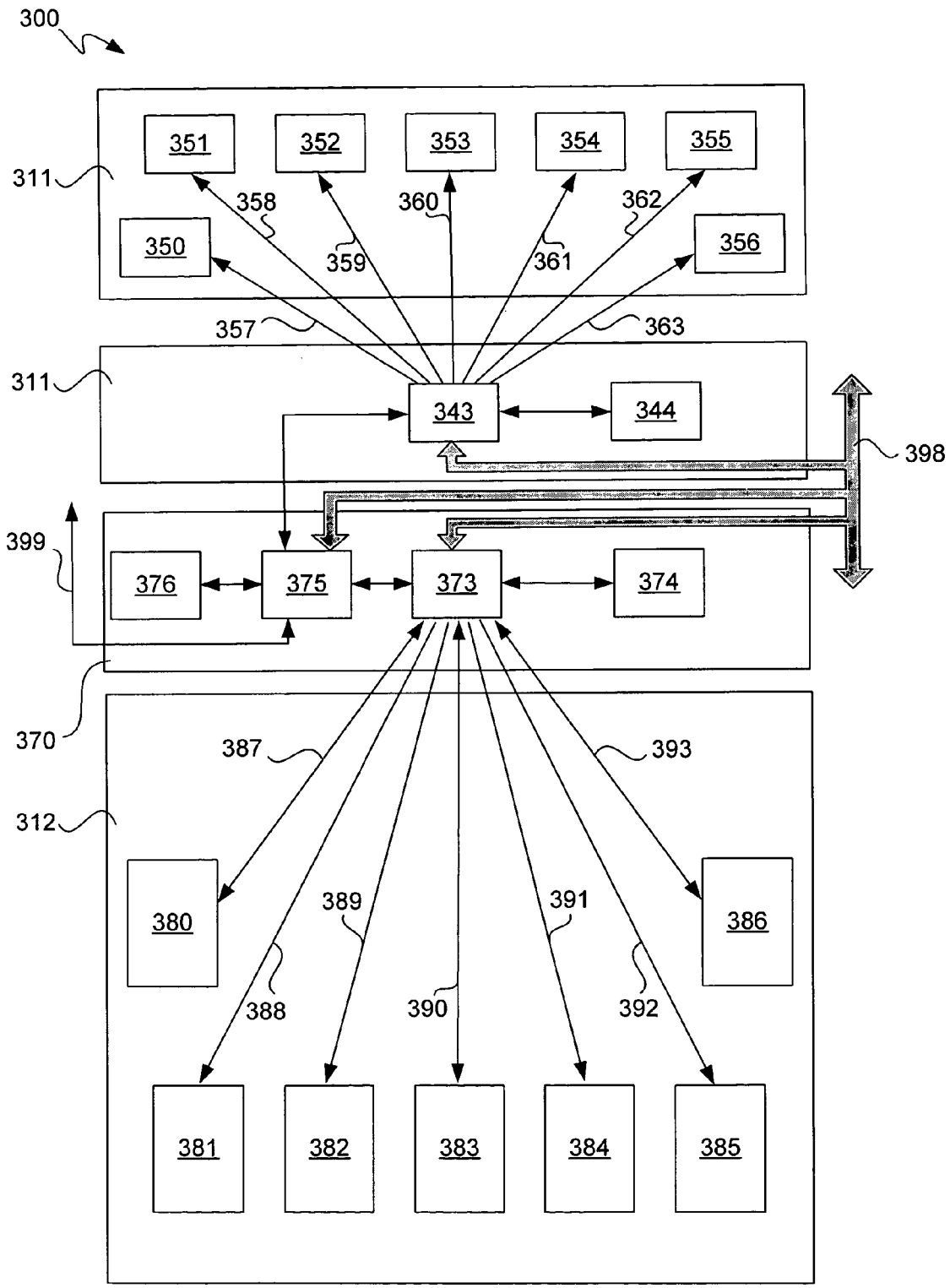
FIGS. 8A and 8B illustrate block diagrams of various exemplary electronic component infrastructures for the alternative gaming machine having an interchangeable top box, interchangeable main cabinet, universal top box engine and universal main cabinet engine of FIGS. 7A and 7B according to one embodiment of the present invention.
Figure 8B:
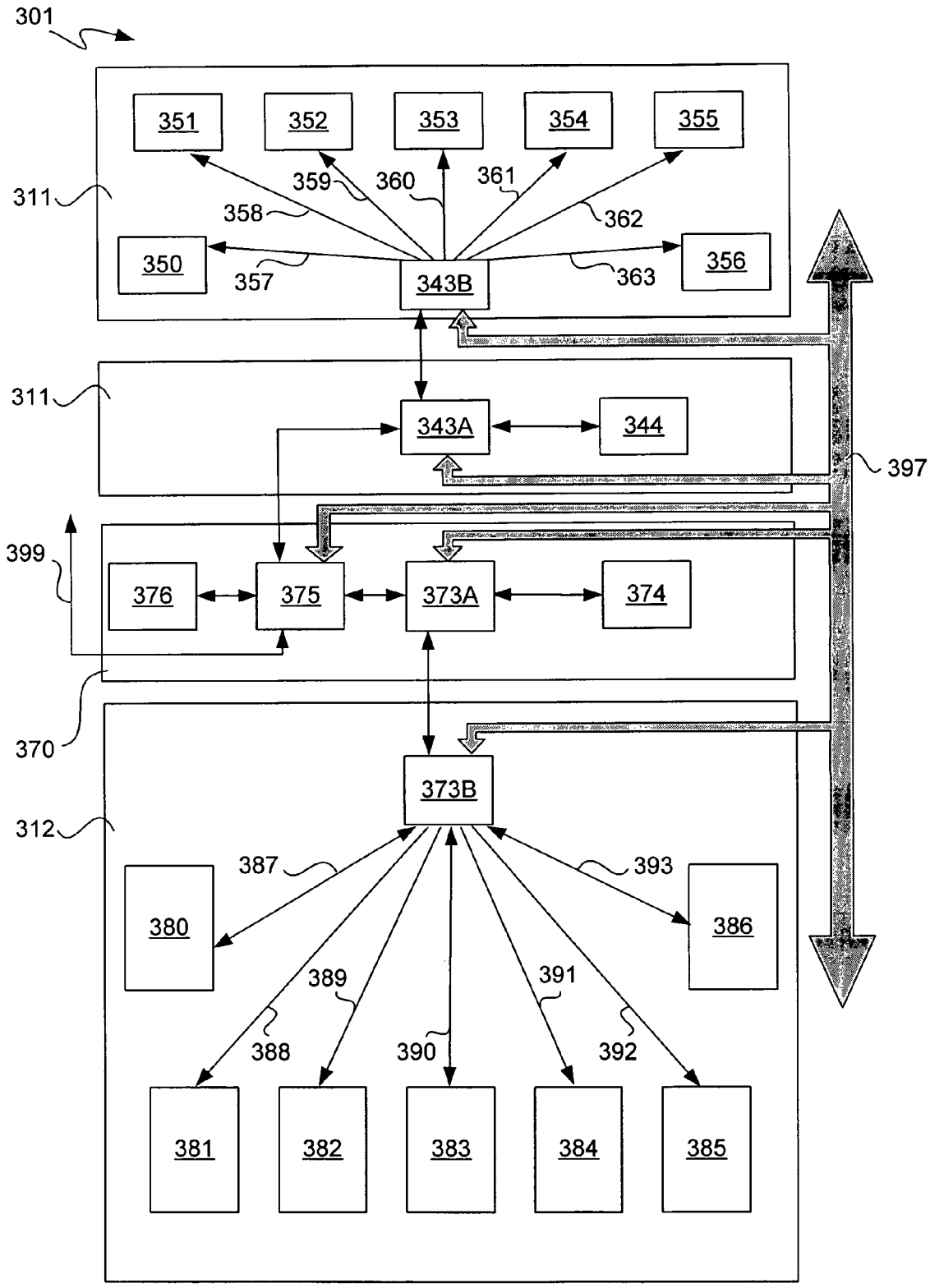

Referring now to FIGS. 8A and 8B, two different exemplary electronic component infrastructures for the alternative gaming machine shown in FIGS. 7A and 7B are illustrated in simplified block diagram format. As illustrated in FIG. 8A, gaming machine 300 is broken into four major components, with those being main cabinet 312, universal main cabinet engine 370, universal top box engine 340 and top box 311. Each of these four major components is substantially similar to a counterpart component as described in one of the foregoing embodiments, such that a repeated detailed discussion is not necessary. Brief summaries thus follow, with it being understood that many more connections and items and wider varieties of each may be included over the examples provided here.

For example, top box 311 contains various peripheral devices, which can be, for example, an additional video display 350, one or more speakers 351, various individual bulbs or lights 352, a separate progressive jackpot display 353, a ticket printer 354, a stepper motor 355, and a generic top box peripheral device 356. Modes or links of communication to these devices can include, for example, a DVI type line 357, an analog line 358, a custom serial line 359, a Netplex line 360, an RS-232 line 361, a USB line 362, and a Ethernet line 363. Similarly, main cabinet 312 contains various peripheral devices, which can be, for example, a touchscreen and touchscreen display 380, a bezel light 381, a pay table 382, a bill acceptor 383, a coin acceptor 384, a coin hopper 385, and a generic main cabinet peripheral device 386. Modes or links of communication to these devices can include, for example, a USB line 387, a custom serial line 388, an RS-232 line 389, a Netplex type communication line 390, another custom serial line 391, yet another custom serial type of line 392 and another serial line 393. As in the foregoing embodiments noted above, each of connections 357-363 and 387-393 are preferably detachable at mating hardware interfaces (not shown in FIG. 8) between the respective major component and its controlling universal gaming engine.

In this embodiment, MGC 375 is similarly included within the universal main cabinet engine 370, which thus acts as a base unit, to better facilitate the nature of main cabinet 312 as a removable and interchangeable modular unit. It will be readily appreciated that this MGC may also be housed in the removable main cabinet itself, with reorganization and rewiring of components made as appropriate. In any event, a communication link 399 may connect the MGC 375 with an outside system, network or server, as in the foregoing embodiments described above. In addition to MGC 375 and at least one associated storage unit or memory device 376, the universal main cabinet engine also includes at least one dedicated processing unit 373, such as a CPU, which is adapted to control some or all of the peripheral devices located within or on main cabinet 312. This universal main cabinet engine CPU 373 is particularly adapted so as to receive communications and commands from the gaming machine MGC 375, to process these commands itself or through other processors and/or devices within the universal main cabinet engine, and then issue commands to, communicate with and control many or all of the peripheral devices contained within or on main cabinet 312. At least one associated storage unit or memory device 374 is included for use in conjunction with universal main cabinet engine CPU 373.

Also substantially similar to a foregoing embodiment is universal top box engine 340, which contains at least one dedicated processing unit, such as a CPU 343, and one or more associated storage units or memory devices 344. This universal top box engine CPU 343 is particularly adapted so as to receive communications and commands from the gaming machine MGC 375, to process these commands itself or through other processors and/or devices within the universal top box engine, and then issue commands to, communicate with and control many or all of the peripheral devices contained on top box 311. These and other details from one or more of the foregoing embodiments may also apply for universal top box engine 340 of gaming machine 300, and indeed for each of the other major components here, top box 311, main cabinet 312 and universal main cabinet engine 370.

In addition, a common bus or other communication line 398 may also be installed, such that additional modes of communication across gaming machine 300 are possible. Such a common bus may be an Ethernet, token ring or other similar type bus, as desired. As shown, common bus 398 permits some communications to bypass the MGC 375, such as when a communication is to be made directly from CPU 343 to CPU 373. Such an arrangement can be desirable for a variety of reasons, as will be readily apparent to those skilled in the art. Use of a bus such as common bus 398 can be even more useful in the event that additional CPUs or processors are implemented within the gaming machine, as in the following example.

As shown in FIG. 8B, gaming machine 301 is substantially similar to gaming machine 300 of the previous example. However, gaming machine 301 does contain additional processors within both the top box and main cabinet. Accordingly, universal top box engine CPU 343A communicates directly with top box CPU 343B across a common interface, while gaming engine CPU 373A communicates directly with main cabinet CPU 373B across another common interface. Of course, it is possible to implement only one such additional CPU, as desired. Also, common bus 397 carries a level of additional importance, in that it now interfaces with at least five separate CPUs, such that direct communications can be had between varying combinations of CPUs without the need for a forced chain of communication. For example, CPU 343B can communicate directly with CPU 373B without the need for the communication to be carried through CPU 343A, MGC 375 and CPU 373A. Of course, use of such a common bus or like element is contemplated for all potential embodiments of the present invention.

Similar to the foregoing embodiment above, it is specifically contemplated that an additional CPU or processor be placed within the main cabinet itself, such that gaming engine CPU 273 communicates directly with this additional processing unit within the main cabinet. Such a relationship can be similarly beneficial in the event that a "Smart Interface" with a reduced number of ports or connections between the universal main cabinet engine and the main cabinet is implemented. Such a use can also result in the main cabinet 212 becoming a "smart peripheral" in that one processor within the main cabinet controls and directs activity within the main cabinet, while the entire main cabinet or at least a face portion thereof is removable with respect to the remainder of the gaming machine. In yet another embodiment, gaming engine CPU 273 can be located within the main cabinet itself, with the MGC 275 communicating directly with the gaming engine CPU 273 across an interface between the main cabinet and gaming engine.

Figure 9A:
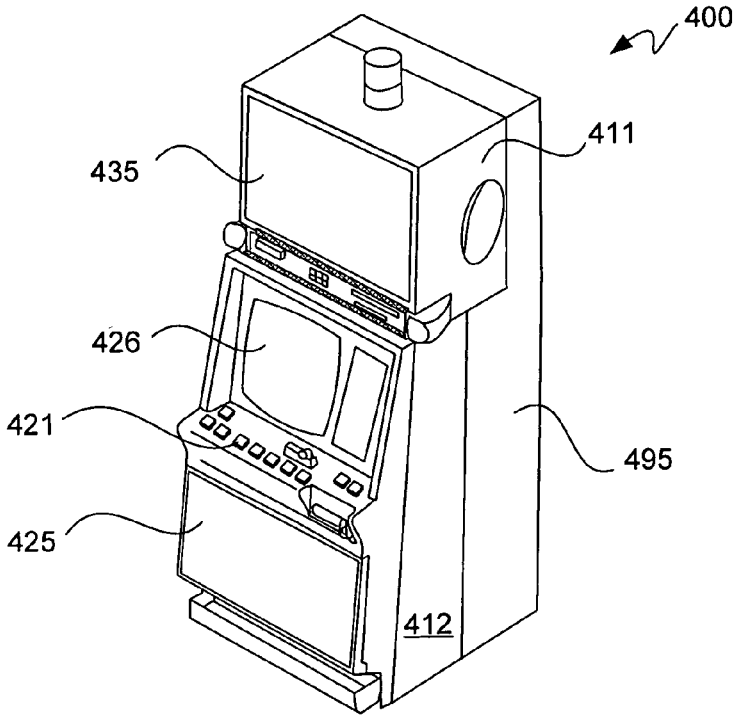
FIGS. 9A and 9B illustrate in perspective view still another alternative gaming machine having an interchangeable top box, interchangeable main cabinet, and integrated universal gaming engine according to one embodiment of the present invention.
Figure 9B:
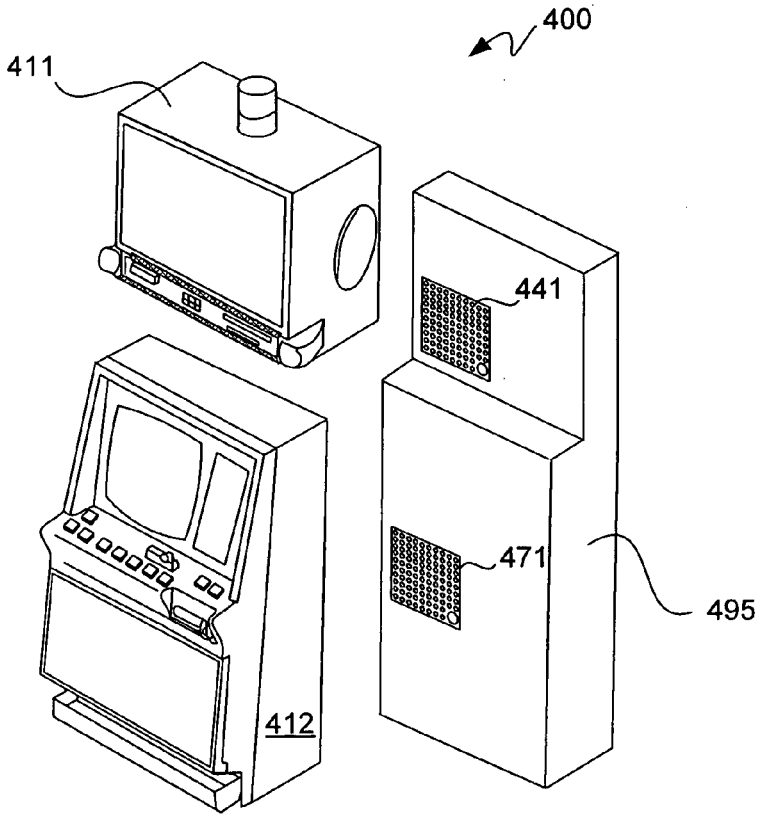

Turning now to FIGS. 9A and 9B, still another alternative gaming machine having an interchangeable top box, interchangeable main cabinet, and integrated universal gaming engine according to one embodiment of the present invention is illustrated in perspective view. Similar to each of the previously illustrated gaming machines, alternative gaming machine 400 is also a gaming device that is generally adapted for accepting wagers from and granting monetary awards to players. Much like foregoing gaming machines 100, 200 and 300, alternative gaming machine 400 is also illustrated as generally box-like, although such a difference is again considered insubstantial, such that gaming machines of any shape or size can be used with this embodiment. As in the previous examples, gaming machine 400 also includes a top box 411 and main cabinet 412 with a number of features substantially similar to those found in the previous gaming machine, such as, for example, one or more player-input switches or buttons 421, a belly glass 425, a primary video display monitor 426, and a secondary video display monitor 435, among others. As will again be readily appreciated, not all of the foregoing exemplary features are necessary and many other features or items not illustrated may also be present or used in place of any of the features that are shown for purposes of the present invention.

Similar to gaming machine 300 from the previous embodiment, both top box 411 and main cabinet 412 are removable from gaming machine 400, and one or both can preferably be interchanged with numerous other top boxes and main cabinets that are similarly adapted to attach to this particular gaming machine. Similar to the foregoing embodiments, such other top boxes and main cabinets can be substantially similar to top box 411 and/or main cabinet 412, or, significantly, can be of different shapes, sizes and/or game themes, and can contain fewer, more or different peripheral devices having differing functionalities than those of top box 411 and/or main cabinet 412. Unlike the foregoing embodiment, however, the removal and interchangeability of top box 411 and main cabinet 412 from gaming machine 400 is facilitated by one universal gaming engine, specifically an integrated universal gaming engine 495. Accordingly, both top box 411 and main cabinet 412 can be tested, repaired, upgraded or otherwise altered while separate from the remainder of gaming machine 400, and then put back into place on the gaming machine. Alternatively, a different top box and/or different main cabinet with identical, similar, or substantially different parts and components can be put into place on gaming machine 400.

Similar to the foregoing embodiments discussed in detail above, integrated universal gaming engine 495 contains a number of components and features that enable the modular removal of the top box 311, main cabinet 312, or both, and such various components and features are identical or at least substantially similar to those detailed above, such that further repetition here is not necessary. As in the prior examples, integrated universal gaming engine 495 is a stand-alone component that attaches to one or more major gaming machine components, such as a top box, a main cabinet or another universal gaming engine. As in the prior examples, each of these universal gaming engines are adapted such that bi-directional communications are possible with one or more major components to which it attaches. Various benefits inherent to this embodiment mirror those of the previously disclosed embodiments. In addition, the integrated nature of this universal gaming engine 495 is advantageous in that the benefits of both a universal top box engine and a universal main cabinet engine can be had in a single modular integrated universal gaming engine.

As seen in FIG. 9B, one permutation for a gaming machine having an integrated universal gaming engine has the top box 411 and main cabinet 412 both being removable as separate units from the remainder of the gaming machine 400, particularly the integrated universal gaming engine 495. As above, one or more of these major components can be adapted such that physical docking stations are created for the convenient removal and insertion for these major components, with various features or components used for such an adaptation, as listed above. As also in the previous examples, various standardized hardware interfaces, such as electrical plates or grids, legacy plugs or other suitable communication plates are preferably built into a faces of the top box and the main cabinet, with mating hardware interfaces similarly built into the abutting side of the integrated universal gaming engine. As before, any such interface can be a Smart Interface or a Full Interface, with both of those possibilities being substantially similar to those types of interfaces as described above.

As shown in FIG. 9B, each of integrated universal gaming engine to top box connector plate 441 and integrated universal gaming engine to main cabinet connector plate 471 is a standardized grid of communication ports or connections, along with a ported connection to transmit power from the universal main cabinet engine to the main cabinet. As before, one or more of such connector plates can contain, for example, 100 or so individual communication ports or connections, such that more specific instructions for individual peripheral devices or items can be transmitted directly from the appropriate controlling universal gaming engine. Again, these individual communication ports or connections are preferably organized according to a standard, such that similar devices should always or usually connect to the same port. Of course, other details, features and examples from the interfaces disclosed above for other embodiments can also apply, and it is specifically contemplated that a mixture of Smart and Full Interfaces can be used throughout gaming machine 400, as desired.

Figure 10:
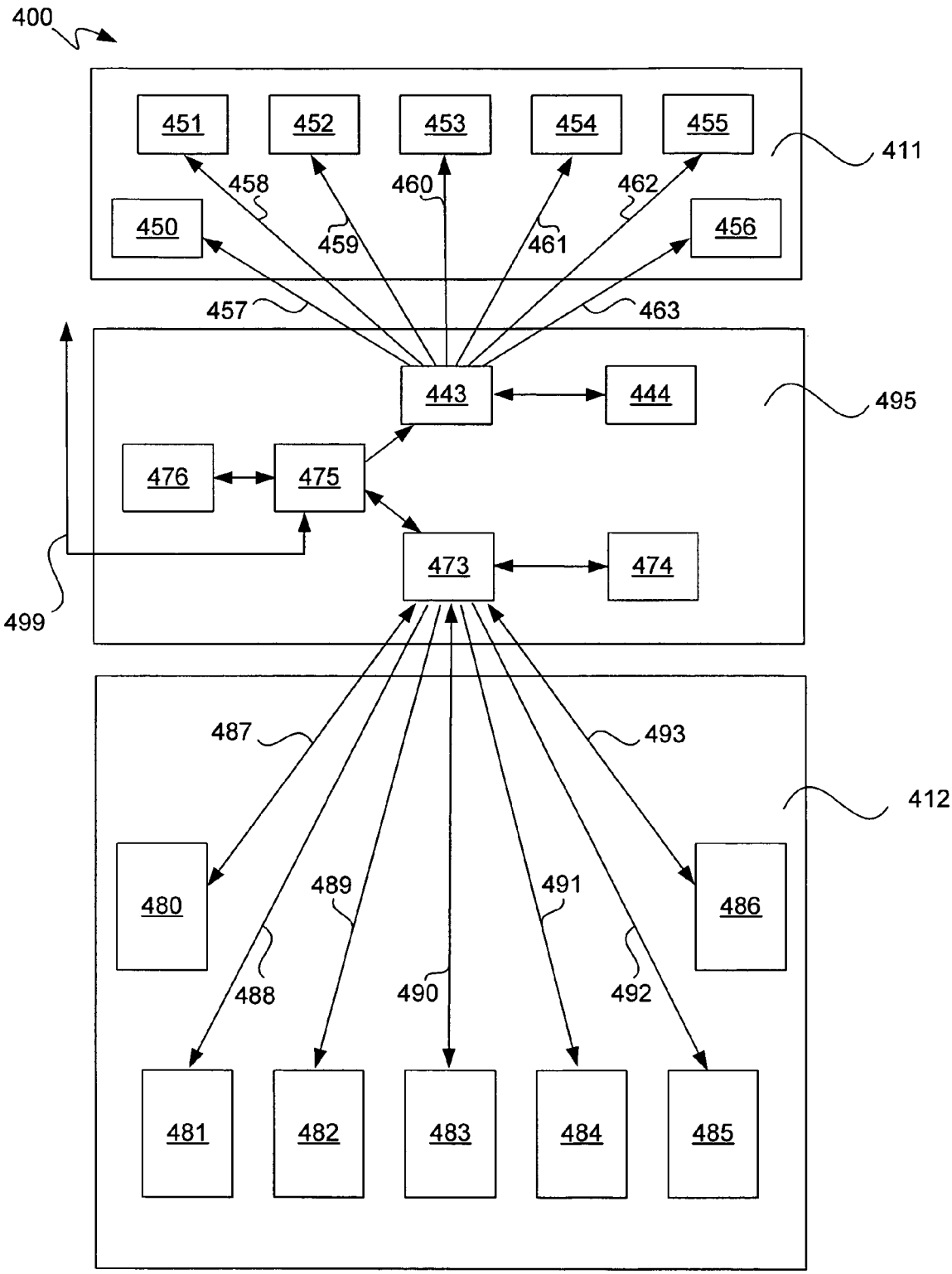
FIG. 10 illustrates a block diagram of an exemplary electronic component infrastructure for the alternative gaming machine having an interchangeable top box, interchangeable main cabinet, and integrated universal gaming engine of FIGS. 9A and 9B according to one embodiment of the present invention.

Referencing FIG. 10, a block diagram illustrates an exemplary electronic component infrastructure for the alternative gaming machine of FIGS. 9A and 9B. As illustrated, gaming machine 400 is broken into three major components, with those being main cabinet 412, integrated universal gaming engine 495 and top box 411. While the top box 411 and main cabinet 412 are substantially similar to counterpart top boxes and main cabinets from prior examples, such that a repeated discussion for each is not necessary, the integrated universal gaming engine 495 is a combination of the universal top box and main cabinet engines from the previous embodiment.

Top box 411 thus contains various peripheral devices 450-456 connected to the integrated universal gaming engine 495 via various communication links or modes 457-463. Actual examples for each can be taken from those discussed in greater detail above for other embodiments. Similarly, main cabinet 412 contains various peripheral devices 480-486 that are connected to the integrated universal gaming engine 495 via various communication links or modes 487-493. Again, specific examples for each of these can be referenced in the foregoing embodiments. As noted above, the peripheral devices and communication links or modes shown represent but a small sample of the number and variety of devices and links that can be used. As also similarly noted above, each of connections 457-463 and 487-493 are preferably detachable at mating hardware interfaces (not shown in FIG. 10) between the respective major component and integrated universal gaming engine 495.

In this embodiment, MGC 475 is similarly included within the integrated universal gaming engine 495, which thus acts as a base unit, to better facilitate the nature of both top box 411 and main cabinet 412 as removable and interchangeable modular units. It will be readily appreciated that this MGC may also be housed in the removable main cabinet itself, with reorganization and rewiring of components made as appropriate. As above, a communication link 499 may connect the MGC or an appropriate intermediary device with an outside system, network, server or other device. In addition to MGC 475 and at least one associated storage unit or memory device 476, the integrated universal gaming engine also includes at least one dedicated main cabinet controlling processing unit 473 adapted to control some or all of the peripheral devices located within or on the main cabinet, as well as at least one dedicated top box controlling processing unit 443 adapted to control some or all of the peripheral devices located within or on the top box. Each of these main cabinet controlling and top box controlling CPUs 443, 473 is particularly adapted so as to receive communications and commands from the gaming machine MGC 475, to process these commands itself or through other processors and/or devices within the dedicated main cabinet processing unit 473, and then issue commands to, communicate with and control many or all of the peripheral devices contained within or on top box 411 or main cabinet 412 respectively. At least one associated storage unit or memory device 474 is included for use in conjunction with main cabinet controlling CPU 473, while at least one associated storage unit or memory device 444 is similarly included for use in conjunction with top box controlling CPU 443. Other details and features found in substantially similar components or parts of components from prior embodiments may also apply those found in gaming machine 400, as desired.

Figure 11:
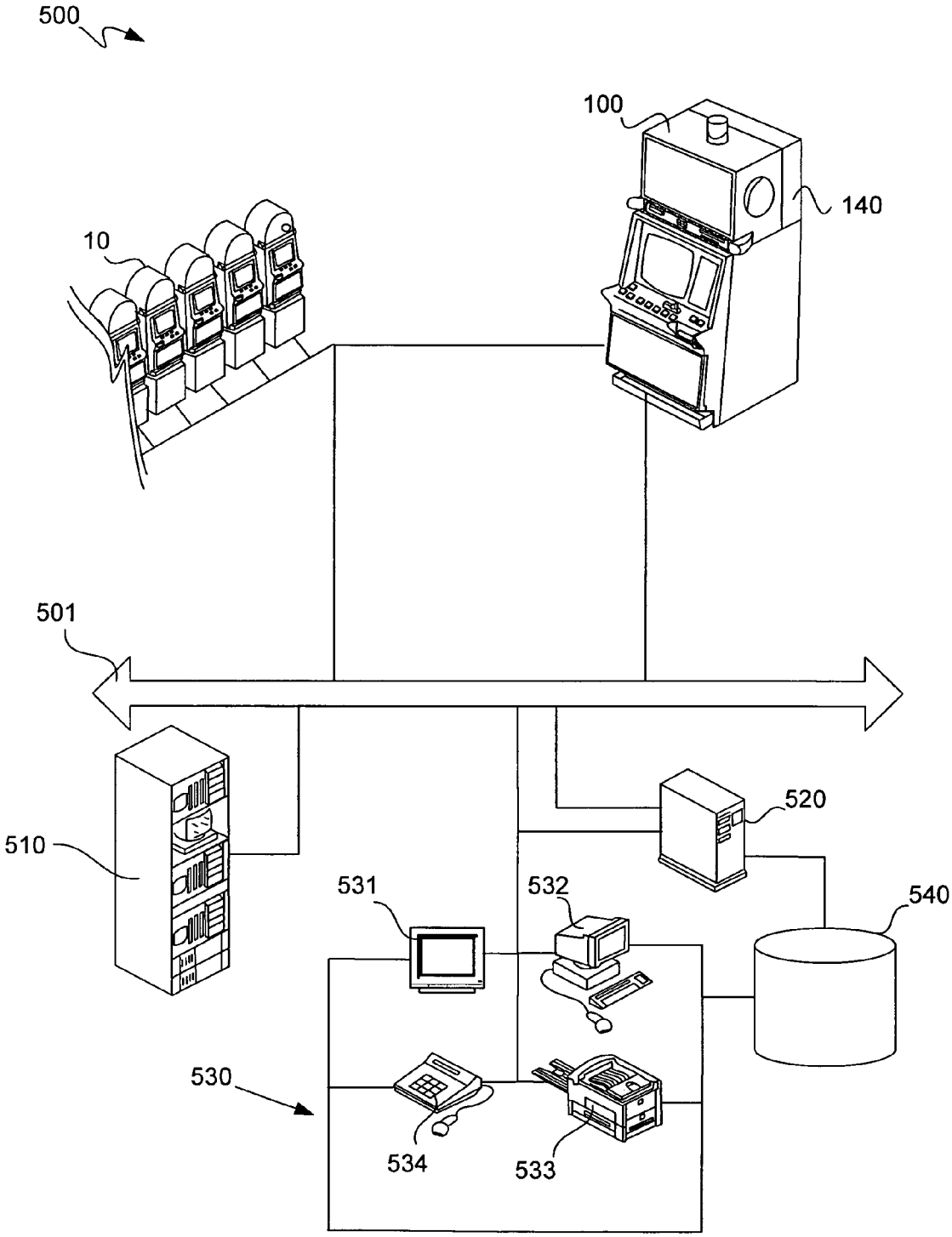
FIG. 11 illustrates a block diagram of an exemplary gaming machine system or network including one or more gaming machines having a universal gaming engine according to one embodiment of the present invention.

Turning now to FIG. 11, a block diagram of an exemplary gaming machine system or network including one or more gaming machines having a universal gaming engine according to one embodiment of the present invention is illustrated. In this embodiment, a provided system, and preferably a network or like structure, is adapted to connect a plurality of gaming machines together, with at least one of the included gaming machines having a universal gaming engine, such as a universal top box engine, a universal main cabinet engine, or an integrated universal gaming engine. Accordingly, system 500 contains a plurality of gaming machines 10 in one or more locations, and at least one gaming machine 100 with a universal gaming engine, such as universal top box engine 140. A common network bus 501 preferably connects these gaming machines via any desired operable connection means with other network components, which can include, for example, a general-purpose server 510.

Such a general-purpose server 510 may be one that is already present within an establishment for one or more other purposes in lieu of or in addition to system management and system component tracking or inventory monitoring. Other functions for such a networked general-purpose server include, for example, accounting and payroll functions, Internet and e-mail capabilities, switchboard communications, reservations and other hotel and restaurant operations, and other assorted general establishment operations. In some instances, system management and inventory functions may also be associated with or performed by such a general-purpose server. For example, such a server may be linked to one or more gaming machines within an establishment, and in some cases form a network that includes all or substantially all of the gaming machines within that establishment. Communications can then be exchanged from each machine to one or more inventory programs on the general-purpose server. For example, the server may be programmed to poll each machine for affirmative status or potential change out activity on a periodic basis to determine whether all is well with that machine and whether any recent changes have occurred. In addition, the server can be programmed to monitor or track any movement or transaction for any of the gaming machines or major components under its domain, such that any changing out or moving of major gaming machine components as disclosed herein can be recorded.

In a particularly preferred embodiment, however, system 500 also has at least one additional special purpose or inventory server 520, which is used for various functions relating to inventory and tracking of gaming machines and major components of gaming machines in the system. Such an additional inventory server is desirable for a variety of reasons, such as to lessen the burden on the general-purpose server or to isolate or wall off some or all inventory information from the general-purpose server and thereby limit the possible modes of access to such information, in the event that security access is an issue. In addition, inventory server 520 may be used as the exclusive recording and controlling entity for any system needs or inquiries with respect to any inventory tracking of gaming machines and major components of gaming machines being undertaken by an establishment. Alternatively, system 500 can be isolated from any other network within the establishment, such that a general purpose server 510 is entirely impractical, and such that a special purpose server 520 dedicated solely to inventory matters is implemented. Under either embodiment of an isolated or shared system or network, inventory server 520 also preferably includes connections to a sub-network 530 of one or more network accessing devices, as well as a database or other suitable storage medium 540. Network devices may include, but are not limited to, one or more video monitors 531, one or more user terminals 532, one or more printers 533, and one or more other digital input devices 534, such as a card reader or other security identifier, as desired.

Database 540 is preferably adapted to store many or all files or data related to various gaming machines and major components for same, such that these files or data are readily accessible. Database 540 is thus preferably directly accessible by one or more of the network devices on sub-network 530 connected to inventory server 520, such that data specific to gaming machines or major components of gaming machines on the database may be readily retrieved and reviewed at one or more of these network devices. Parameters for storing such files or data can vary widely, and are left up to the discretion of the system administrators. In addition, it is contemplated that one or more network devices on sub-network 530 may also be connected directly to common bus 501, as illustrated.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A gaming machine adapted for accepting wagers and granting monetary awards, comprising:

a master gaming controller adapted to control game play and authorize payouts and other awards on said gaming machine, said master gaming controller located in a main cabinet of said gaming machine, said main cabinet having a first communications interface having a first configuration or arrangement;

a top box that contains a plurality of peripheral devices and a second communications interface having a second configuration or arrangement, said top box adapted to be removable from said gaming machine and interchangeable with other top boxes also so adapted; and a modular universal gaming engine located outside said main cabinet and said top box, said modular universal gaming engine having at least one dedicated processing unit, at least one associated storage device, a third communications interface adapted to connect with said first communications interface, and a fourth communications interface adapted to connect with said second communications interface, wherein said modular universal gaming engine is adapted to control a substantial portion of said plurality of peripheral devices contained by said top box, wherein said modular universal gaming engine is located substantially behind said main cabinet, said top box, or said main cabinet and said top box.

2. The gaming machine of claim 1, wherein said top box is adapted to detach from said main cabinet.

3. The gaming machine of claim 2, wherein said modular universal gaming engine is adapted to remain attached to said gaming machine despite any detachment of said top box.

4. The gaming machine of claim 1, wherein said modular universal gaming engine is interposed between said main cabinet and said top box, and said top box and said modular universal gaming engine are adapted to detach from said main cabinet as a combined unit.

5. The gaming machine of claim 4, wherein said top box is adapted to detach from said modular universal gaming engine.

6. The gaming machine of claim 1, wherein said modular universal gaming engine is adapted to control all peripheral devices on said top box.

7. The gaming machine of claim 6 wherein said peripheral devices contained by said top box include all of the following: a video display, one or more speakers, a plurality of bulbs, a separate progressive jackpot display, and a ticket printer.

8. The gaming machine of claim 7 wherein said video display has a video controller, said plurality of bulbs has a separate light controller, said separate progressive jackpot display has its own specialized controller, and said ticket printer has a printer controller.

9. The gaming machine of claim 1, wherein said modular universal gaming engine is adapted to control all of said plurality of peripheral devices on said top box.

10. The gaming machine of claim 1, wherein said modular universal gaming engine contains a power supply adapted to provide power to said top box.

11. The gaming machine of claim 1, wherein said modular universal gaming engine comprises a communications buffer between said master gaming controller and said substantial portion of said plurality of peripheral devices on said top box.

12. The gaming machine of claim 1, wherein said at least one dedicated processing unit comprises a central processing unit residing on said modular universal gaming engine.

13. The gaming machine of claim 12, wherein said central processing unit contains resident operating system code adapted to control functions associated with said modular universal gaming engine and facilitate communications between said modular universal gaming engine and said master gaming controller.

14. The gaming machine of claim 13, wherein said resident operating system code is specifically approved for use in said gaming machine by a gaming jurisdiction.

15. The gaming machine of claim 13, wherein said resident operating system code is selected from the group of operating system codes consisting of Windows CE Embedded, Windows XP, Linux, MontaVista Linux, and QNX.

16. The gaming machine of claim 1, wherein said plurality of peripheral devices comprises one or more devices selected from the group consisting of a video display unit, a speaker, an audio amplifier, a light, a touch screen, an input button, a coin acceptor, a bill acceptor, a ticket acceptor, a coin hopper, a coin dispenser, a ticket printer, a card reader and a mechanical motor.

17. The gaming machine of claim 1, wherein said second configuration or arrangement comprises a standardized layout of physical connections that is consistent across a plurality of other modular universal gaming engines.

18. The gaming machine of claim 17, wherein said standardized layout of physical connections comprises a grid of ported connections.

19. The gaming machine of claim 17, wherein said standardized layout of physical connections comprises a power connection adapted to provide power across a mating of said second communications interface and said fourth communications interface.

20. A gaming machine adapted for accepting wagers and granting monetary awards, comprising:

a processing means for controlling game play and authorizing payouts and other awards on said gaming machine, said processing means located in a main cabinet of said gaming machine and communicatively connected with a first communications interface located on said main cabinet, said first communications interface having a first configuration or arrangement;

a housing means for housing a plurality of peripheral devices associated with said gaming machine and a second communications interface, said housing means being removable from said main cabinet and interchangeable with other similar housing means also so adapted, said plurality of peripheral devices communicatively connected with said second communications interface, and said second communications interface having a second configuration or arrangement; and a modular universal engine means for controlling a substantial portion of said plurality of peripheral devices housed by said housing means, said modular universal engine means located outside said main cabinet and said housing means, said modular universal engine means including a third communications interface and a fourth communications interface, said third communications interface adapted to connect with said first communications interface, and said fourth communications interface adapted to connect with said second communications interface, wherein said modular universal engine means are located substantially behind said main cabinet, said housing means, or said main cabinet and said housing means.

21. A system of gaming machines adapted for accepting wagers and granting monetary awards, comprising:

at least one computer server, said at least one computer server having a program adapted to provide data regarding individual modular universal gaming engines, top boxes of gaming machines, or both; and a plurality of gaming machines in communication with said at least one computer server, wherein at least one first gaming machine of said plurality of gaming machines comprises:

a master gaming controller adapted to control game play and authorize payouts and other awards on said at least one first gaming machine, said master gaming controller located in a main cabinet of said at least one first gaming machine and communicatively connected with a first communications interface located on said main cabinet, said first communications interface having a first configuration or arrangement;

a top box, wherein said top box contains a plurality of peripheral devices and a second communications interface, is adapted to be removable from said at least one first gaming machine, and is interchangeable with other top boxes also so adapted, wherein said plurality of peripheral devices are communicatively connected with said second communications interface, said second communications interface having a second configuration or arrangement; and a modular universal gaming engine located outside said main cabinet and said top box, said modular universal gaming engine having at least one dedicated processing unit, at least one associated storage device, a third communications interface, and a fourth communications interface, wherein said third communications interface is connected with said first communications interface, said fourth communications interface is connected with said second communications interface, and said modular universal gaming engine is adapted to control a substantial portion of said plurality of peripheral devices contained by said top box, wherein said top box is removable and interchangeable, and wherein said modular universal gaming engine is located substantially behind said main cabinet, said top box, or said main cabinet and said top box.

22. The system of gaming machines of claim 21, wherein said data regarding individual universal gaming engines, top boxes of gaming machines, or both comprises one or more informational items for such devices, said one or more informational items selected from the group consisting of current location, past locations, time in service, number of retrofits, repair status, included peripheral devices, peripheral device configurations and overall thematic nature of said device.

23. The system of gaming machines of claim 21, wherein said top box is adapted to detach from said main cabinet.

24. The system of gaming machines of claim 21, wherein said modular universal gaming engine is adapted to control said substantial portion of said plurality of peripheral devices contained by said top box.

25. The system of gaming machines of claim 21, wherein said modular universal gaming engine is adapted to control all of said plurality of peripheral devices contained by said top box of said at least one first gaming machine.

26. The system of gaming machines of claim 21, wherein said at least one dedicated processing unit comprises a central processing unit residing on said modular universal gaming engine, said central processing unit containing resident operating system code adapted to control functions associated with said modular universal gaming engine and facilitate communications between said modular universal gaming engine and said master gaming controller, wherein said resident operating system code is specifically approved for use in said at least one first gaming machine by a gaming jurisdiction.

27. The system of gaming machines of claim 21, wherein said first configuration or arrangement comprises a standardized layout of physical connections that is consistent across a plurality of other modular universal gaming engines.

28. A method of replacing a top box of a gaming machine adapted for accepting wagers and granting monetary awards, the method comprising:

providing said gaming machine having a master gaming controller adapted to control game play and authorize payouts and other awards on said gaming machine, said master gaming controller located in a main cabinet of said gaming machine and communicatively connected with a first communications interface located on said main cabinet, said first communications interface having a first configuration or arrangement, said top box that contains a plurality of peripheral devices and a second communications interface, said top box adapted to be removable from said gaming machine and interchangeable with other top boxes also so adapted, said second communications interface having a second configuration or arrangement, and a modular universal gaming engine located outside said main cabinet and said top box, said modular universal gaming engine having at least one dedicated processing unit, at least one associated storage device, a third communications interface, and a fourth communications interface, wherein said modular universal gaming engine is adapted to control a substantial portion of said plurality of peripheral devices on said top box, said third communications interface is connected with said first communications interface, and said fourth communications interface is connected with said second communications interface, wherein said modular universal gaming engine is located substantially behind said main cabinet, said top box, or said main cabinet and said top box;

removing said top box from said gaming machine; and installing a second top box on said gaming machine.

29. The method of claim 28, wherein said modular universal gaming engine is adapted to control said substantial portion of said plurality of peripheral devices contained by said top box.

30. A method of changing a game theme on a gaming machine adapted for accepting wagers and granting monetary awards, said method comprising:

providing said gaming machine having a master gaming controller adapted to control game play and authorize payouts and other awards on said gaming machine, said master gaming controller located in a main cabinet of said gaming machine and communicatively connected with a first communications interface located on said main cabinet, said first communications interface having a first configuration or arrangement, a top box that contains a plurality of peripheral devices and a second communications interface, said top box adapted to be removable from said gaming machine and interchangeable with other top boxes also so adapted, said second communications interface having a second configuration or arrangement, and a modular universal gaming engine located outside said main cabinet and said top box, said modular universal gaming engine having at least one dedicated processing unit, at least one associated storage device, a third communications interface, and a fourth communications interface, wherein said modular universal gaming engine is adapted to control a substantial portion of said plurality of peripheral devices on said top box, where said top box is removable and interchangeable, said third communications interface is adapted to connect with said first communications interface, and said fourth communications interface is adapted to connect with said second communications interface, wherein said modular universal gaming engine is located substantially behind said main cabinet, said top box, or said main cabinet and said top box;

removing said top box from said gaming machine, said top box comprising one or more items dedicated toward a first game theme; and installing a second top box on said gaming machine, said second top box comprising one or more items dedicated toward a second game theme different from said first game theme.

* * * * *